US010458083B2

(12) United States Patent
Adler

(10) Patent No.: US 10,458,083 B2
(45) Date of Patent: Oct. 29, 2019

(54) METHOD AND SYSTEM FOR A RISING FLOODWALL SYSTEM

(71) Applicant: RSA Protective Technologies, LLC, Claremont, CA (US)

(72) Inventor: Richard Steven Adler, Claremont, CA (US)

(73) Assignee: RSA PROTECTIVE TECHNOLOGIES, LLC, Claremont, CA (US)

( * ) Notice: Subject to any disclaimer, the term of this patent is extended or adjusted under 35 U.S.C. 154(b) by 0 days.

(21) Appl. No.: 16/023,888

(22) Filed: Jun. 29, 2018

(65) Prior Publication Data

US 2018/0305881 A1 Oct. 25, 2018

Related U.S. Application Data

(63) Continuation of application No. 15/043,348, filed on Feb. 12, 2016, now Pat. No. 10,036,133.

(60) Provisional application No. 62/176,359, filed on Feb. 12, 2015.

(51) Int. Cl.

| | |
|---|---|
| ***E02B 3/10*** | (2006.01) |
| ***E02B 7/26*** | (2006.01) |
| ***E02B 7/36*** | (2006.01) |
| ***E02B 7/50*** | (2006.01) |

(52) U.S. Cl.

CPC ..... *E02B 3/102* (2013.01); *E02B 3/104* (2013.01); *E02B 7/26* (2013.01); *E02B 7/36* (2013.01); *E02B 7/50* (2013.01)

(58) Field of Classification Search

CPC combination set(s) only.
See application file for complete search history.

(56) References Cited

U.S. PATENT DOCUMENTS

| | | | |
|---|---|---|---|
| 4,582,451 | A | 4/1986 | Hollander, Jr. |
| 5,460,462 | A | 10/1995 | Regan |
| 5,725,326 | A | 3/1998 | Van den Noort |
| 6,042,301 | A | 3/2000 | Sovran |
| 6,338,594 | B1 | 1/2002 | Adler et al. |
| 6,623,209 | B1 | 9/2003 | Waters, Jr. |
| 7,972,081 | B2 | 7/2011 | Linares |
| 8,500,365 | B1 | 8/2013 | Vecherin et al. |
| 9,267,254 | B2 | 2/2016 | Gujer |
| 9,458,588 | B2 | 10/2016 | Waters, Jr. |
| 2001/0006591 | A1 | 7/2001 | Nomura et al. |
| 2007/0116522 | A1 | 5/2007 | Boudreaux, Jr. |
| 2009/0220301 | A1 | 9/2009 | Miyao et al. |
| 2011/0110722 | A1 | 5/2011 | van den Noort |
| 2012/0163916 | A1 | 6/2012 | Waters, Jr. |
| 2012/0163917 | A1 | 6/2012 | Waters, Jr. |
| 2013/0209173 | A1 | 8/2013 | Quek |
| 2014/0140770 | A1 | 5/2014 | Nakayasu |

(Continued)

*Primary Examiner* — Sean D Andrish
(74) *Attorney, Agent, or Firm* — Haug Partners LLP

(57) ABSTRACT

The present invention relates to a retractable floodwall system comprising a floodwall panel installed in a housing unit. The floodwall panel is connected with a counter-balance weight. The floodwall panel is capable of being raised from the housing unit and being lowered into the housing unit. The present invention also relates to a method of flood prevention comprising providing a floodwall panel in a housing unit; connecting the floodwall panel with a counter-balance weight; raising the floodwall panel from the housing unit for flood prevention; and lowering the floodwall panel into the housing unit.

14 Claims, 20 Drawing Sheets

(56) References Cited

U.S. PATENT DOCUMENTS

| | | | |
|---|---|---|---|
| 2015/0337583 | A1 | 11/2015 | Fukagawa et al. |
| 2016/0010298 | A1 | 1/2016 | Waters, Jr. |
| 2016/0369469 | A1 | 12/2016 | Kelly |

METHOD AND SYSTEM FOR A RISING FLOODWALL SYSTEM

RELATED APPLICATIONS

The present application is a continuation of U.S. application Ser. No. 15/043,348 filed on Feb. 12, 2016, which claims benefit to Provisional Application No. 62/176,359 filed on Feb. 12, 2015, the entireties of which are incorporated herein by reference. The present application is also related to U.S. Pat. No. 6,338,594 filed on Nov. 19, 1999, the entirety of which is incorporated herein by reference.

FIELD OF THE INVENTION

The invention disclosed herein relates generally to a retractable floodwall system for flood prevention. Specifically, the retractable floodwall system includes counter-balanced and deployable floodwall panels that can be raised to a desired height in anticipation of a flooding event.

BACKGROUND

In general, conventional floodwalls represent permanent structures with fixed heights to protect buildings or lands from flood damage. Although these permanent structures are functional in providing the flood protection, they do not aesthetically blend well with adjacent environment and can negatively impact scenery. In addition, permanent floodwalls obstruct pedestrian and automobile traffic. Therefore, there is a need for a floodwall system that can be deployed quickly before a storm and can be displaced or concealed when no storm is imminent.

SUMMARY

The retractable floodwall system as set forth in the present invention provides a solution to the need for an on-demand floodwall system with retractable floodwall panels. The floodwall panels are deployed when a flood threat is anticipated and concealed when the flood threat is gone. According to one embodiment, the floodwall panels are configured to be stored in a stowed position inside a housing unit that is part of the floodwall system when flood protection is not needed. In case of a flooding threat, the floodwall panels of the embodiment are raised to a desirable height by an actuating mechanism, for example, electric motors, hydraulic motors, buoyant force, or human power, to provide flood protection. The lower portion of the floodwall panel is configured to be in contact with the housing unit, thus preventing the raised floodwall panel from wobbling due to the impact of floodwater and the debris. The floodwall system of the embodiment has counter-balance weights connected with the floodwall panels so that the required force to raise the floodwall panel is substantially reduced. According to another embodiment, the floodwall system has a plumbing system to fill the housing unit with water, either from the flood itself or from a potable water source, to create buoyant force to raise the floodwall panel and to drain the water after use. The floodwall system according to an embodiment includes a controller connected with the components of the system from a remote location, for example by radio signal. In this way, an operator is able to remotely control the actuating mechanism, valves, pumps, and sensors of the floodwall system.

According to an embodiment of the present invention, a retractable floodwall system comprises a floodwall panel installed in a housing unit. The floodwall panel is connected with a counter-balance weight, and an actuation mechanism to raise and lower the floodwall panel out from and into the housing unit. According to an aspect, the floodwall panel includes a buoyant hollow inner space located at a lower section of the floodwall panel. The hollow portion reduces the weight of the floodwall panel and increases its buoyancy. According to various aspects of the present invention, the buoyant lower portion of the floodwall panel includes a plurality of guides. The floodwall panel includes a solid upper section. The floodwall panel may also include a plurality of support legs to maintain the floodwall panel when it is raised from the housing unit. The floodwall panel may also include a latch mechanism.

According to other aspects, the retractable floodwall system includes an actuation mechanism installed to lift and lower the floodwall panel. The actuation mechanism may be an electric motor or a hydraulic motor which works together with a counter-balance weight so only a small powered motor is required to raise or lower the panels. The retractable floodwall system may also include a plumbing system that delivers a fluid into the housing unit. According to this aspect, buoyant force is used to raise and lower the floodwall panel. The retractable floodwall system may also include a floodwater inlet that allows floodwater to enter the housing unit. The flood water inlet may be configured so that the floodwall panel is raised when flood water reaches a predetermined height without the need for human intervention. The retractable floodwall system may also include an exit segment having an underground post with a plurality of openings for utility lines to pass through. The retractable floodwall system may also include an automated deployment device that runs along a track from behind the floodwall system and raises the floodwall panel from the housing unit. Support legs are deployed to keep the floodwall in the raised position. According to this embodiment, water is not needed to move or lock the floodwall in place.

According to an aspect of the present invention, a method of flood protection comprises providing a floodwall panel in a housing unit; connecting the floodwall panel with a counter-balance weight; raising the floodwall panel from the housing unit for flood protection; and lowering the floodwall panel into the housing unit.

According to another aspect, there is provided a method comprising constructing a lower portion of the floodwall panel to be a buoyant portion, installing a plurality of support legs on the floodwall panel, the plurality of support legs supporting the floodwall panel on a surface in a raised position; installing a latch mechanism at a top surface of the floodwall panel; installing an actuator inside the housing unit for lifting and lowering the floodwall panel; installing a plumbing system for delivering a fluid into the housing unit; installing a floodwater inlet on the housing unit that allows floodwater to enter the housing unit; providing an automated deployment device that runs along a track for raising the floodwall panel; or providing a controller that is capable of controlling an operation of the floodwall panel from a remote location.

BRIEF DESCRIPTION OF DRAWINGS

To the accomplishment of the foregoing and related ends, certain illustrative embodiments of the invention are described herein in connection with the following description and the annexed drawings. These embodiments are indicative, however, of but a few of the various ways in which the principles of the invention may be employed and the present invention is intended to include all such aspects and their equivalents. Other advantages, embodiments and novel features of the invention may become apparent from the following description of the invention when considered in conjunction with the drawings. The following description, given by way of example, but not intended to limit the invention solely to the specific embodiments described, may best be understood in conjunction with the accompanying drawings, in which.

DETAILED DESCRIPTION

Figure 1B:
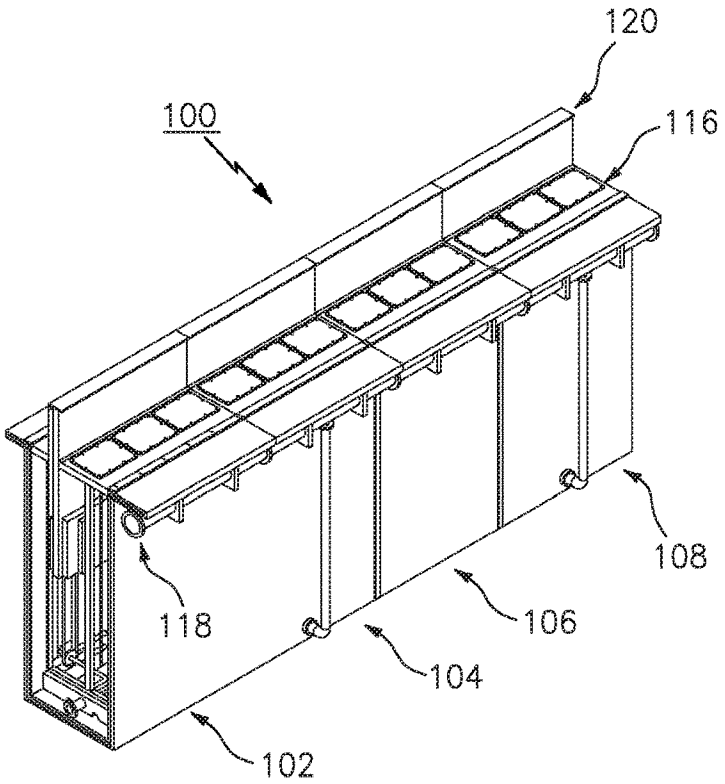
FIG. 1*b* illustrates the floodwall segment of FIG. 1*a* in a raised position according to an embodiment of the present invention.
Figure 1A:
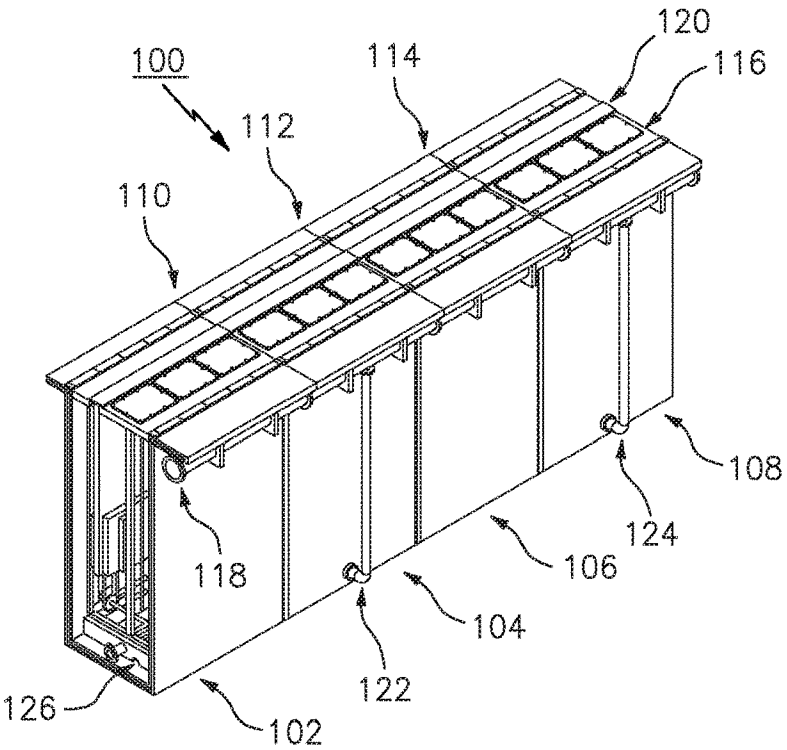
FIG. 1*a* illustrates a floodwall segment of a retractable floodwall system in a stowed position according to an embodiment of the present invention.

FIG. 1*a* illustrates a floodwall segment 100 of a retractable floodwall system according to an embodiment of the present invention. The segment 100 is formed by a plurality of individual units 102, 104, 106, and 108. The plurality of units 102, 104, 106, and 108 are attached with each other and form watertight connections 110, 112, and 114. In one embodiment, the plurality of units 102, 104 106, and 108 are disposed at an underground position with the top surface 116 of the segment 100 at about the grade level. In this way, the segment 100 of the floodwall system is concealed from the view and does not intrude on the surrounding environment. The top surface 116 and supporting structures are configured to have adequate strength to support transportation vehicles, including passenger cars, vans, and trucks that can pass over the floodwall system in the underground position. As shown in FIG. 1*a*, the plurality of units 102, 104, 106, and 108 are preferably at similar elevations to form a smooth top surface 116, along which shared openings between the units can be used for continuous water passage. In one embodiment, the plurality of units 102, 104, 106, and 108 may be placed at different elevations depending on the foundation conditions and variations in the level of the grade.

As shown in FIG. 1*a*, the floodwall segment 100 has a plumbing system 118 that controllably delivers water into the floodwall system. According to an aspect of the present invention, the plumbing system 118 delivers water into the floodwall system to create a buoyant force to lift a floodwall panel 120 to a desired height. The plumbing system 118 also removes water from the system to lower or retract the floodwall panel 120. As will be explained below, the plumbing system 118 may use either municipal water or floodwater for filling the floodwall system.

In one embodiment, every unit is filled simultaneously by the plumbing system 118. In another embodiment, the plumbing system 118 has selected filling or draining connections to the plurality of units 102, 104, 106, and 108. For example, as shown in FIG. 1*a*, the units 102 and 106 have neither filling connections nor draining connections with the plumbing system 118, which may be called a "plain unit." These "plain units" are hydraulically connected with adjacent units 104 and 108 to allow water to enter and exit. Each of the units 104 and 108 has a connection with the plumbing system such as connections 122 and 124. The connections 122 and 124 may be used for draining or filling water or both. Depending on the functions of connections with the plumbing system, the units 104 and 108 may be used as a draining unit or a filling unit or both. If the connection 122 of the unit 104 is used to drain water with a pump, such as a sump pump, the unit 104 may be called a "draining unit." If the connection 124 of the unit 108 is used to fill water, the unit 106 may be called a "filling unit." By providing units with various functions, the retractable floodwall system as set forth in the present invention can provide flood protections to different customer's needs at various levels of costs.

Each unit 102, 104, 106, and 108 has a compartment 126 that accommodates the movable floodwall panel 120, which is normally stored in a stowed position as shown in FIG. 1*a*. In the stowed position, the floodwall panel 120 is disposed inside the compartment and is concealed from the view. According to an embodiment, the movable floodwall panel 120 is raised from the compartment 126 and thus deployed to provide flood protection. The movable floodwall panel 120 may be deployed to different heights depending on the flood level. As shown in FIG. 1*b*, the floodwall panel 120 is raised partway from the compartment 126. In this position, about half of the floodwall panel 120 is above the top surface 116, while the other half of the floodwall panel 120 is still inside the compartment 126. The floodwall pane 120 may be raised by any suitable methods, including human labor, machine, and buoyant force.

Figure 2B:
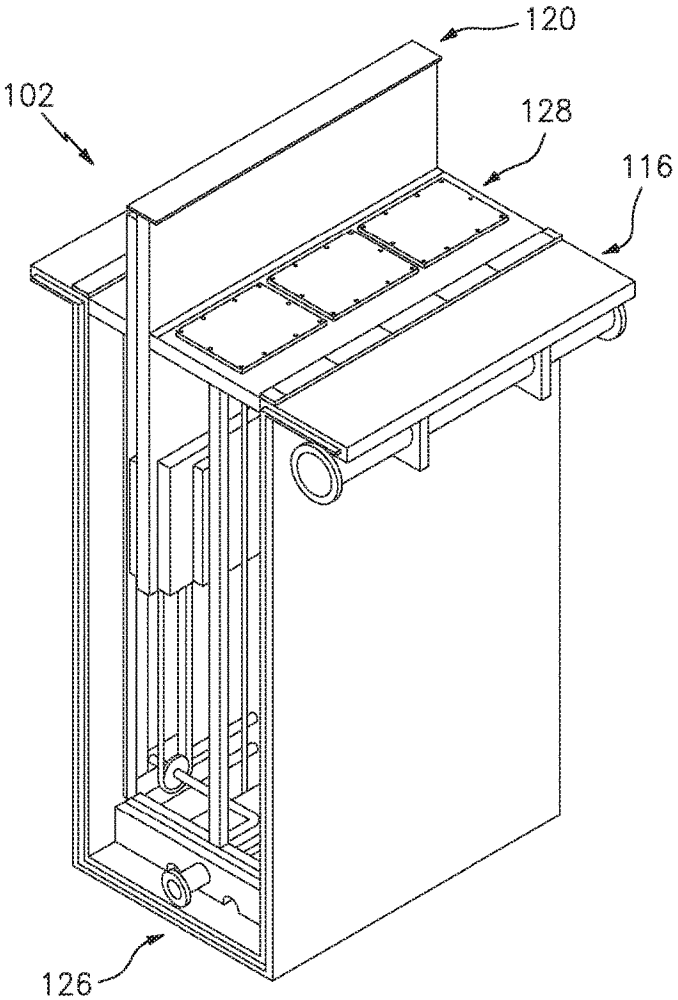
FIG. 2*b* illustrates the floodwall unit of FIG. 2*a* in a raised position according to an embodiment of the present invention.
Figure 2A:
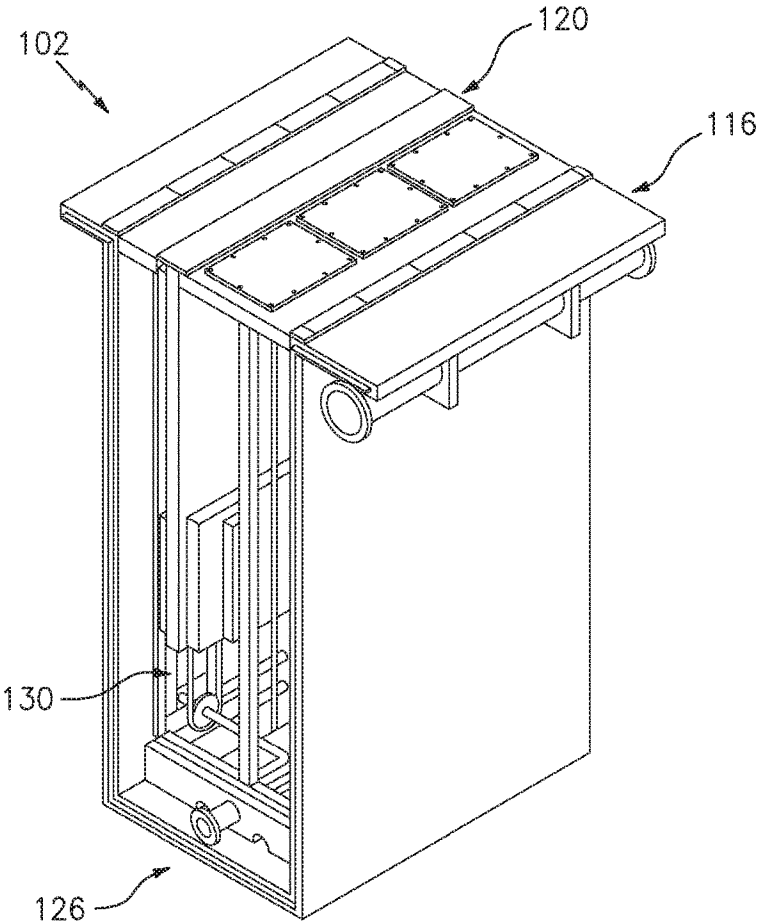
FIG. 2*a* illustrates a floodwall unit in a stowed position according to an embodiment of the present invention.

FIGS. 2*a* and 2*b* show the unit 102 with the floodwall panel in a stowed position and a partway deployed position. Inside the compartment 126, the movable floodwall panel 120 is connected with a transmitting mechanism 130, such as pulleys, gears, chains, and cables, which are used to raise and lower the floodwall panel 120 to a counterweight located behind the floodwall panel. The unit 120 also has actuators inside the compartment 126. The actuator engages with the transmitting mechanism 130 and produces lifting or lowering forces that are transmitted to the floodwall panel. The transmitting mechanism also includes a counter-balance weight. By the use of the counter-balance weight, the lifting force or lowering force produced by the actuator may only need to be a fraction of the weight of the floodwall panel. The actuator may also be used to keep the floodwall at a desired height above grade less than the full stroke of the floodwall. This reduces the size of the actuator and its power requirement. The actuator may be activated by remote control from a smartphone or from a push button controller at the site. The actuator, the transmitting mechanism, and the counter-balance weight will be disclosed below.

Also shown in FIGS. 2*a* and 2*b*, the top surface 116 includes a plurality of access panels 128. When opened, these access panels 128 allow a maintenance crew to enter or reach into the compartment 126 to conduct examination and repair of the components inside the compartment 126.

Figure 3:
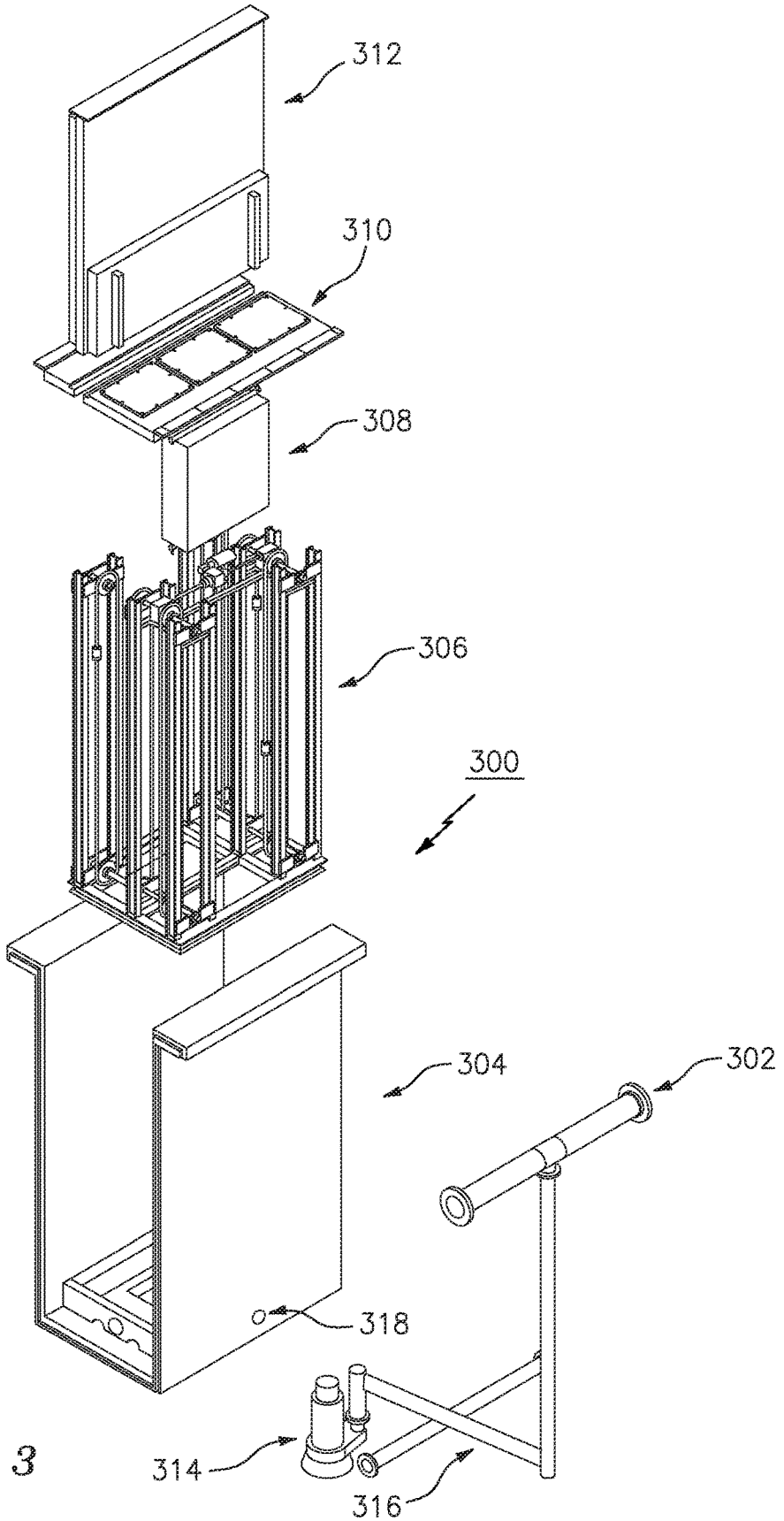
FIG. 3 illustrates an exploded view of a floodwall unit according to an embodiment of the present invention.

FIG. 3 shows an exploded view of a floodwall unit according to an embodiment of the present invention. The floodwall unit 300 includes a plumbing unit 302, a housing unit 304, a support frame 306, a counter-balance weight 308, a surface unit 310, and a floodwall panel 312. According to an embodiment, the plumbing unit 302 has a pump 314 that is disposed at the bottom of the housing unit 304 and is configured to pump water out of the housing unit 304. The plumbing unit 302 has one plumbing section 316 that enters the housing unit 304 via an opening 318 that is located at the bottom part of the housing unit 304. According to an embodiment, the plumbing section 316 may enter the housing unit 304 from the top or bottom part of the housing unit 304. When assembled, the housing unit 304 encloses the support frame 306, the counter-balance weight 308, and the floodwall panel 312 and protects them from outside damage. The support frame 306 supports the floodwall panel 312, the counter-balance weight 308, actuators, and transmitting mechanisms for raising and lowering the floodwall panel 312. The counter-balance weight 308 is connected with the floodwall panel 312 via the transmitting mechanism and balances the weight of the floodwall panel 312 such that the force required to raise or lower the floodwall panel 312 is reduced. The floodwall panel 312, when raised, provides flood protection to property enclosed by the floodwall system. The lower portion of the floodwall remains below grade inside the foundation 304 to reinforce the upper portion against the floodwater's impact, which pounds the exposed portion of the floodwall. The wider base of the lower portion also prevents the floodwall from floating out of the system when floodwater is used as the buoyant force to raise the floodwall.

The surface unit 310 conceals the components inside the housing unit 304 when the floodwall panel is not deployed and serves as a structural surface for regular usage, for example, to support the weight of persons and vehicle passing over the floodwall unit. The surface unit 310 has a plurality of seals configured to prevent water from entering the housing unit 304 when no flood event is occurring, for example, during a normal rain event. The seals may be placed at different locations, including between the surface unit 310 and the housing unit 304, between the surface 310 and the floodwall panel 312, and underneath the access panel 128. The plumbing system, the housing unit, the support frame, the floodwall panel, the counter-balance weight and the surface unit will be discussed below.

As shown in FIG. 3, the plumbing section 302 enters the housing unit 304 via a bottom opening 318 and then connects with a pump 314. In one embodiment, the pump 314 is a sump pump that is used to send water out of the housing unit 314. According to this embodiment, the floodwall unit as shown in FIG. 3 is a draining unit. According to another embodiment, the unit 300 without a pump and connections to the plumbing is a plain unit. Such a plain unit would be hydraulically connected with adjacent units. According to another embodiment, the unit 300 is connected with the plumbing unit but does not include a pump 314. This would be considered a fill unit.

Figure 5:
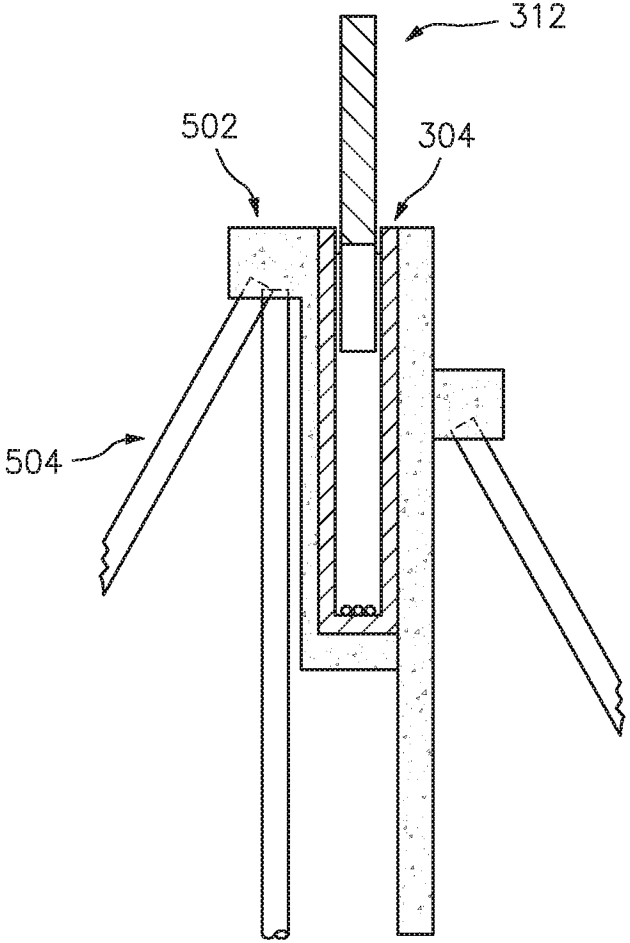
FIG. 5 illustrates a housing unit with a foundation according to an embodiment of the present invention, which includes additional foundation piles to support the housing unit.
Figure 4:
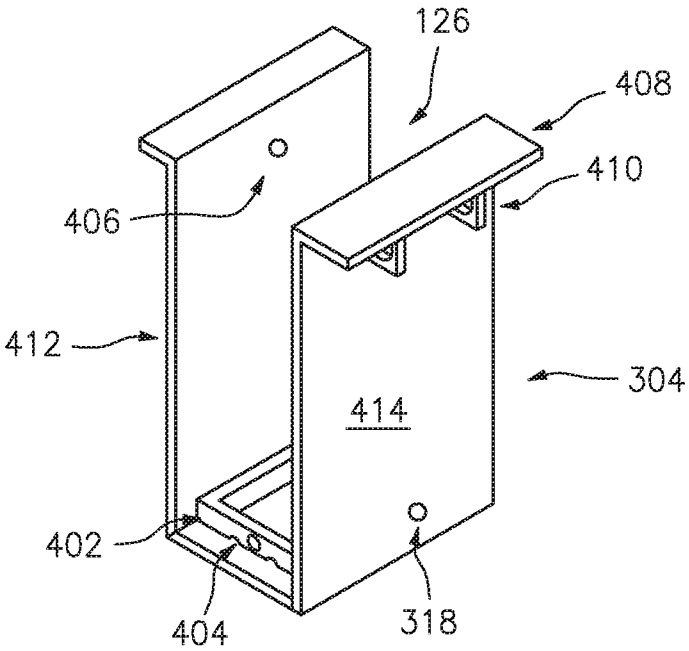
FIG. 4 illustrates a housing unit of a floodwall unit according to an embodiment of the present invention.

FIG. 4 shows a housing unit 304 according to an embodiment of the present invention. FIG. 5 shows a housing unit 304 and a foundation 502 according to another embodiment of the present invention. The foundation 502 is configured to provide a strongback at the dry side, which has greater dimensions than the foundation close to the wet side.

As shown in FIG. 4, the housing unit 304 forms a compartment 126 to accommodate the floodwall panel and other components. The compartment 126 may be of any shape. In one embodiment, the compartment 126 has a substantially rectangular shape. The housing unit 304 has a plurality of horizontal projections 408. When the housing unit is installed, these projections 408 are flush with the grade level and extend in a horizontal direction. The projections 408 are supported by a plurality of structural ribs 410, which have pre-fabricated slots to support the plumbing unit 302. The housing unit 304 has a flood-side wall 412 and a safe-side wall 414. The flood-side wall 412 has an opening 406 at the top of the housing unit 304, which is used to receive flood water. The safe-side wall 414 has an opening 318 at the bottom of the housing unit 304, which is used to remove water from the housing unit 304 or to fill the housing unit with municipal water. At the bottom of the housing unit 304, a protective unit 402 with pre-set openings 404 is used to hold plumbing pipes and allow them to run through the openings 404. The protective unit 402 protects the plumbing pipes from being damaged as well as serving as the bottom of the foundation system that the floodwall sits on. This decreases the contacting surface area between the base of the floodwall and the bottom of the housing unit. The housing unit 304 may be constructed from any material that provides adequate mechanical integrity, including steel, concrete, polymers, composites, wood, or a combination thereof. In a preferred embodiment, the housing unit 304 is constructed from pre-cast reinforced concrete.

As shown in FIG. 5, a foundation 502 may be constructed to support the housing unit 304. When the foundation 502 is used, it may reduce the amount of settlement caused by the weight of the floodwall system, avoid misalignment among floodwall units, and increase the work life of the floodwall system. The foundation is preferably provided around all sides of the housing unit 304. According to an embodiment, the foundation 502 is made of pre-cast concrete and has an inside space similar with the shape of the housing unit 304 such that the housing unit 304 may be lowered into the foundation and fit to the foundation snugly. Fixing mechanisms, such as bolts, screws, concrete, or glues, may be used to attach the housing unit 304 with the foundation 502. In one embodiment, the foundation 502 is further supported by additional batter piles 504 that are driven into the ground. It is noted that the foundation 502 is optional in the present floodwall system. The floodwall system of the present invention can be installed and work property even without a foundation.

Figure 6:
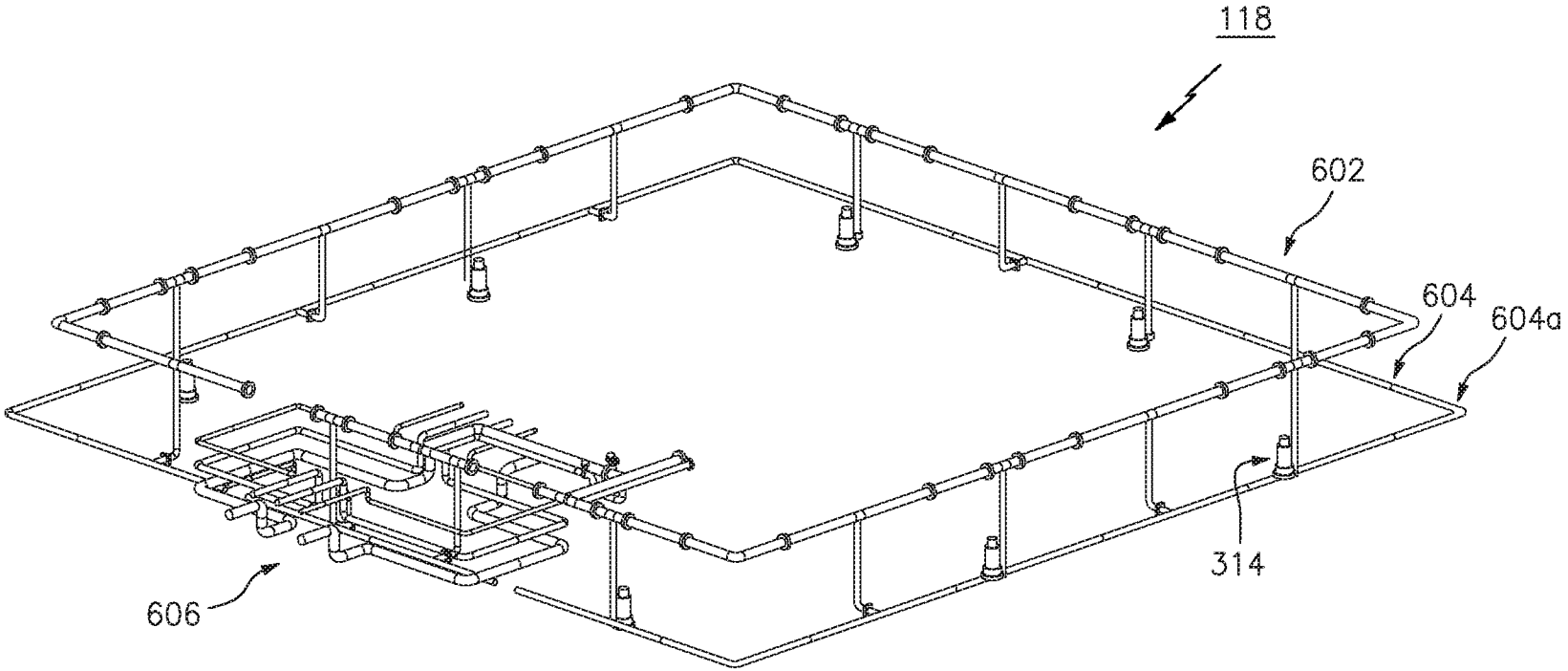
FIG. 6 illustrates a plumbing system of a floodwall system according to an embodiment of the present invention.

FIG. 6 shows the plumbing system 118 of a retractable floodwall system according to an embodiment of the present invention. The plumbing system 118 has an upper section 602 that runs along the upper part of the housing unit 304, a lower section 604 that runs along the bottom part of the housing unit 304, a plurality of pumps 314 that are disposed at the bottom of the housing unit 304, and a manifold section 606. In one embodiment, the upper section 602 is placed outside of the housing unit 304 and has a larger diameter than the lower section 604, which is placed inside the housing unit 304. The upper section 602 is also placed at the safe-side of the floodwall system. The upper section 602 may be connected with storm drains and municipal water via the manifold section 606. The plurality of pumps 314 pump water out of the housing unit 304. In one embodiment, the lower section 604 includes a plurality of sparge pipes 604*a* to facilitate the removal of silt or other debris that may enter the housing unit.

Figure 6A:
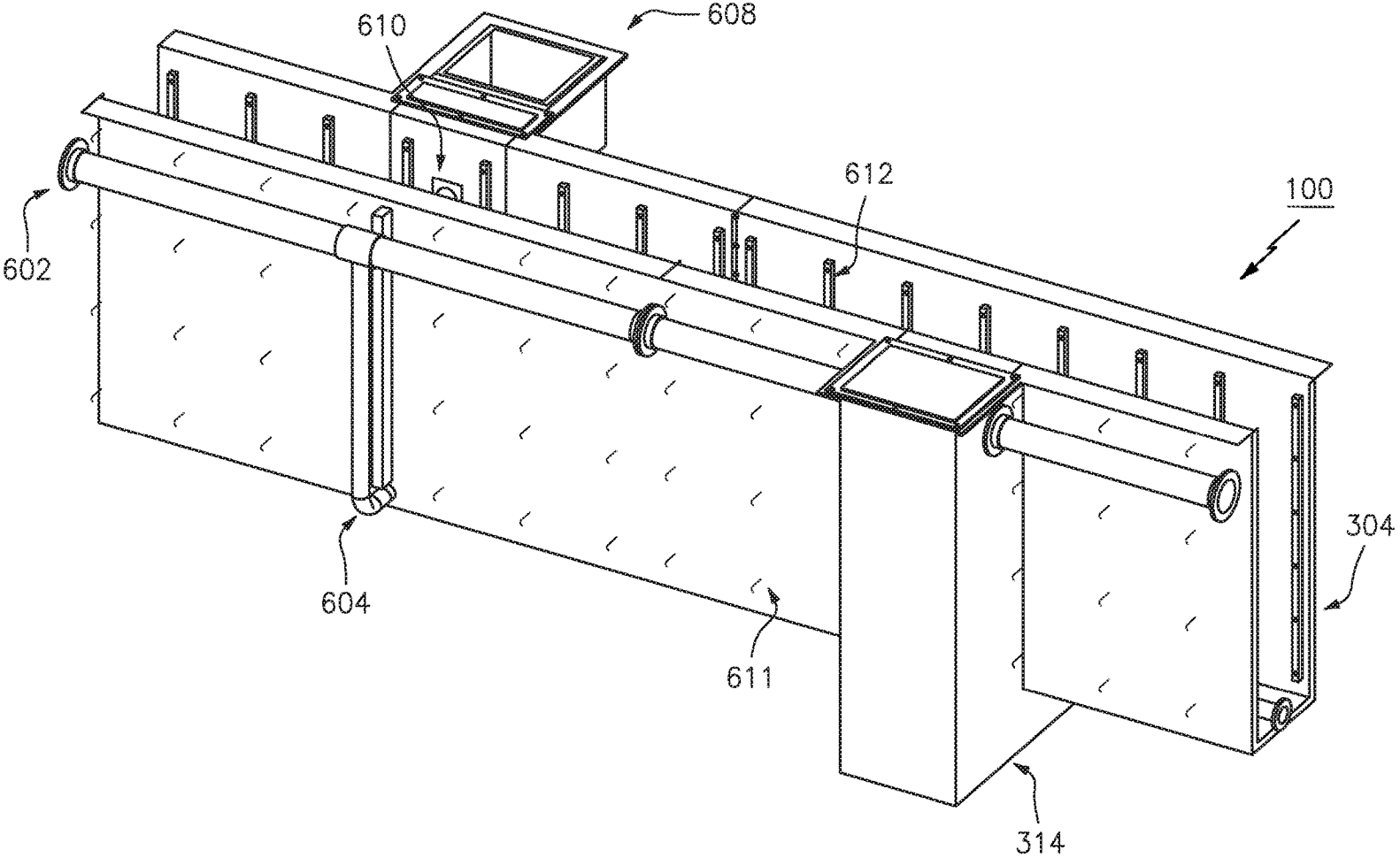
FIG. 6*a* illustrates portions of the plumbing system connected with a housing unit of a floodwall segment according to an embodiment of the present invention.

FIG. 6*a* shows various parts of a floodwall segment 100 according to an embodiment of the present invention. In addition to the plumbing system 118 shown in FIG. 6, the floodwall segment 100 may also include a floodwater inlet 608 that is disposed at the flood-side of the floodwall system. The floodwater inlet 608 is connected with a shutoff valve 610 that regulates the floodwater intake. When the shutoff valve 610 is open, floodwater is allowed to enter the housing unit 304, which will reduce the use of municipal water to fill the housing to raise the floodwall panel. Also shown in FIG. 6*a*, the housing unit 304 includes a plurality of guides 612, which are used to guide the rising of the floodwall panel during the deployment. The surfaces of these guides are preferably treated to have low frictions against the floodwall panel. For example, these guides may have a low friction coating such as Teflon®, a polytetrafluoroethylene based polymer. In one embodiment, the guides are a plurality of projections on the sidewall of the housing unit. In another embodiment, the guides are a plurality of tracks inside the sidewall of the housing unit.

As shown in FIG. 6*a*, the outside of the housing unit has a plurality of spikes 611. In one embodiment, a steel unit, constructed from steel or another metallic material, has the required dimensions to enclose the housing unit. The steel unit also has a plurality of spikes. The steel unit is installed underground first. The spikes secure the steel unit in the surrounding soil. After the steel unit is secured, a pre-cast concrete unit that has the required inside dimension of the housing unit is inserted into the steel unit. The pre-cast concrete unit may also have a plurality of spikes 611 to securely connect the concrete unit to the steel unit. The attachment may be implemented using glue, grout, or poured concrete.

Figure 6B:
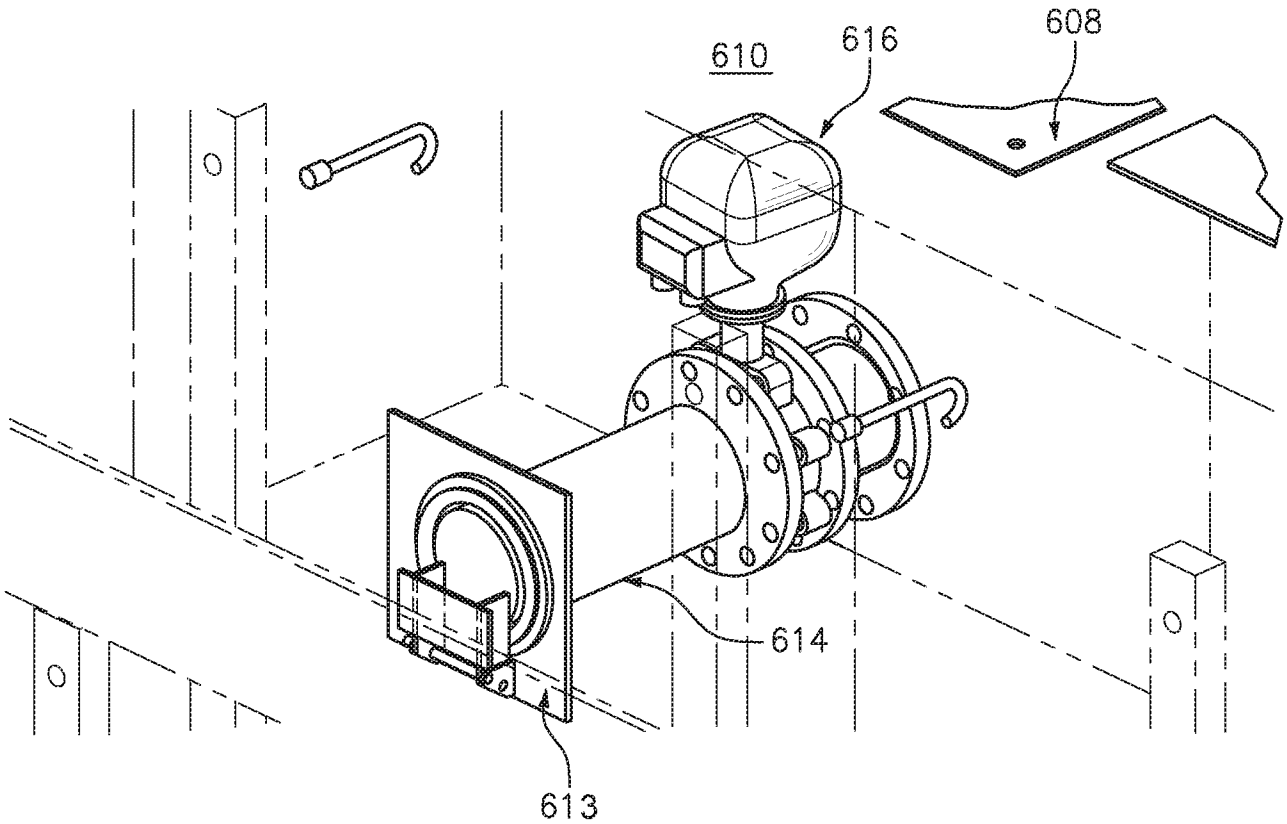
FIG. 6*b* illustrates a shutoff valve of the plumbing system according to an embodiment of the present invention.

FIG. 6*b* shows a shutoff valve 610 according to an embodiment of the present invention. The shutoff valve 610 includes a solenoid valve 616, an opening 614, and a flap gate 613. The solenoid valve 616 may be remotely controllable. For example, the valve 616 may be controlled wirelessly by a smartphone. The opening 614 provides a channel between the inside of the housing unit 314 and the floodwater inlet 608. The flap gate 613 is hinged at the bottom and is normally in an open position, thus allowing floodwater entering the housing unit 304 when the valve 616 is open. The flap gate 613 is moved to a closed position when the floodwall panel 120 is raised. The lower part of the floodwall panel 120 engages with the flap gate 613 when the panel nears its fully raised position. In this way, when the floodwall panel 120 is raised, the flap gate 613 is closed, thus preventing additional floodwater and its sediment from entering the housing unit 304.

Figure 6C:
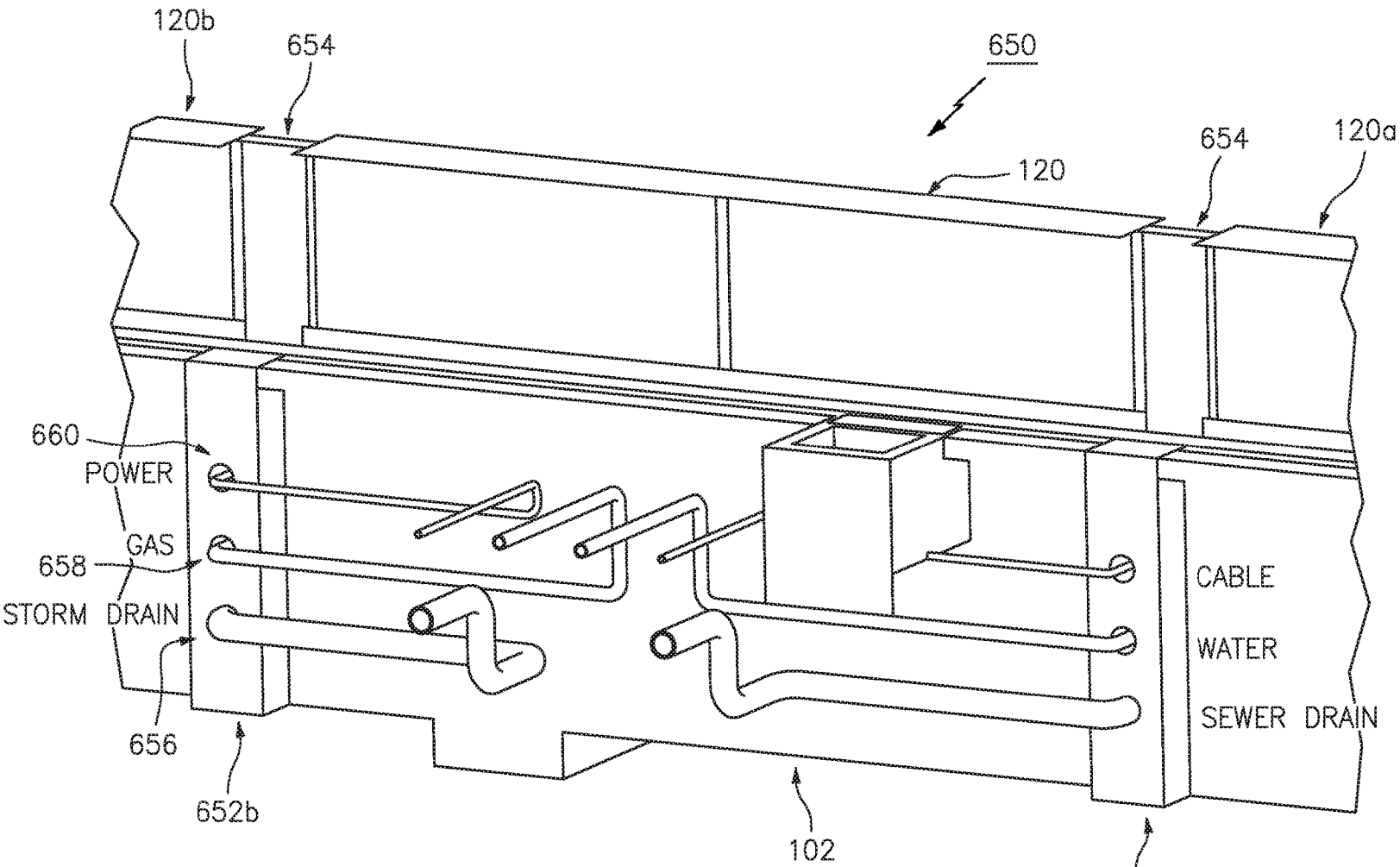
FIG. 6*c* illustrates an exit segment of a floodwall system according to an embodiment of the present invention.
Figure 6D:
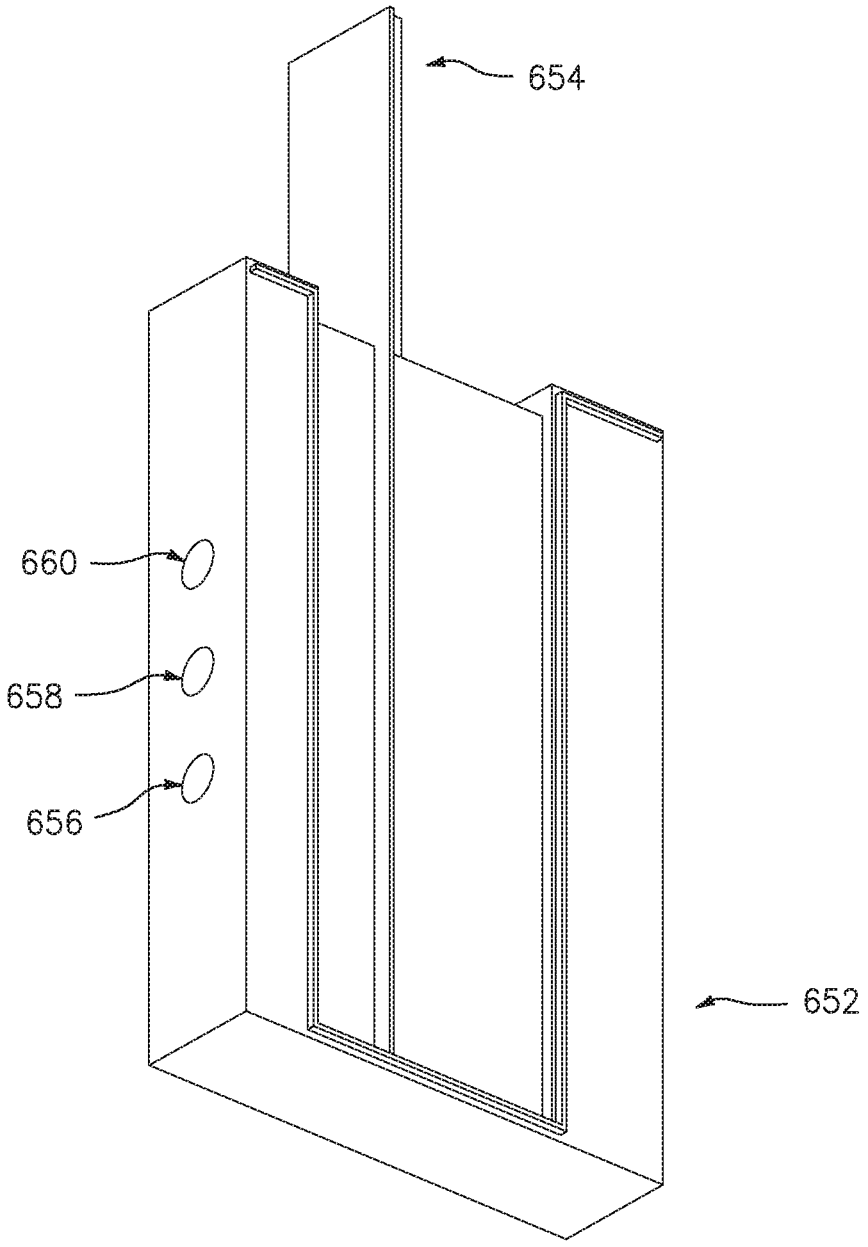
FIG. 6*d* illustrates a removable pillar and through openings of the exit segment according to an embodiment of the present invention.

FIG. 6*c* shows an exit unit of the retractable floodwall system according to an embodiment of the present invention. When the floodwall system is used to protect a building, an entrance and exit access needs to be maintained before the floodwall system fully encircles the building. In addition, the floodwall system needs to be configured to provide access for underground utility lines, such as water, gas, electric, and drain. As the utility lines cannot pass through a movable floodwall panel that will be raised and lowered from time to time, the floodwall system provides underground utility connections through a plurality of fixed underground posts 652*a* and 652*b*. These posts allow the passage of utility lines in a wide range of diameters. In one embodiment, a single post may be used for passing utility lines. The floodwall panel 120 of the exit unit 102 is placed between the fixed posts 652*a* and 652*b* that extend above and below the ground. The floodwall panel 120 is movable and when it is raised, it seals against the fixed posts 652*a* and 652*b*. The utility lines such as power lines, gas line, and storm drains may pass through the underground portion of the posts 652*a* and 652*b* via a plurality of openings 656, 658, and 660. According to one embodiment, fixed posts 652*a* and 652*b* and above-ground pillars 654 are attached and detached from the underground posts to provide a continuous connection between the floodwall panel 120 and adjacent panels. FIG. 6*d* shows an embodiment of the underground post 652 and the pillar 654.

Figure 7A:
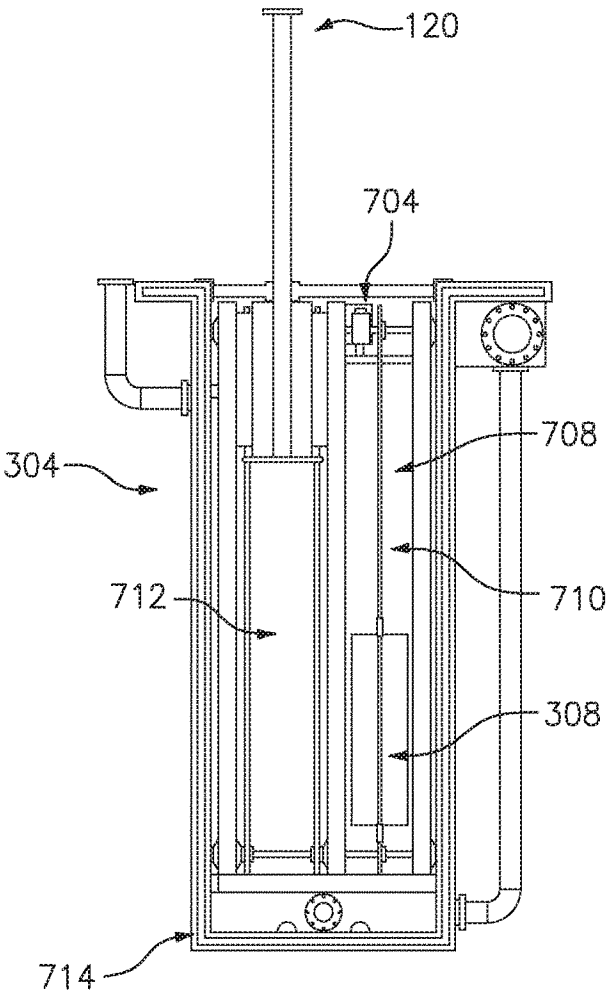
FIG. 7*a* illustrates the connection between a floodwall panel and a counter-balance weight according to an embodiment of the present invention.
Figure 7:
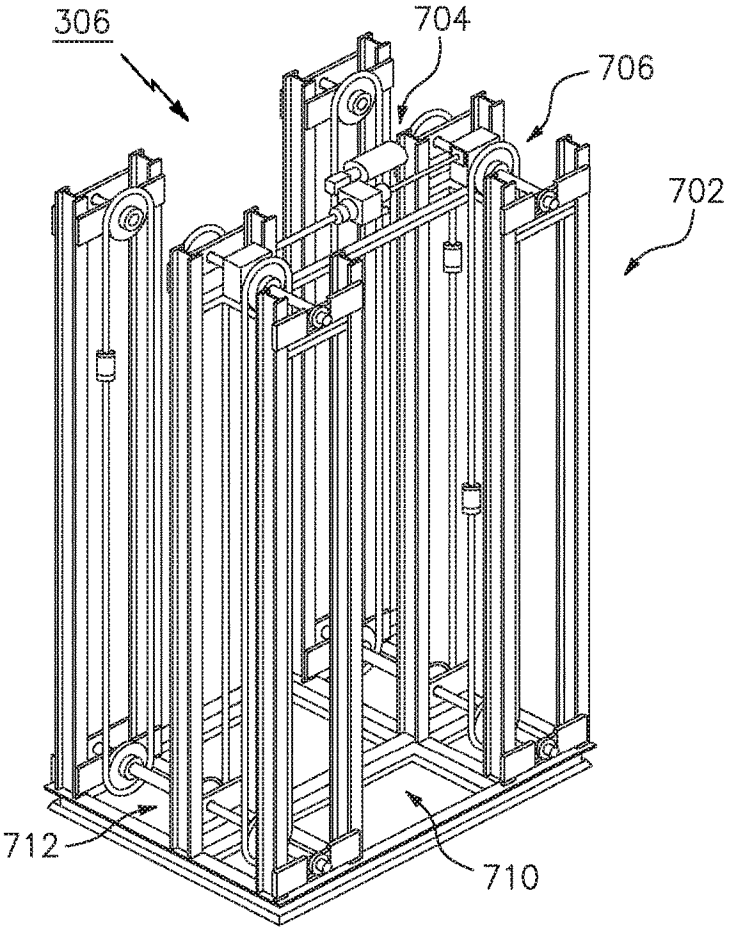
FIG. 7 illustrates a support frame inside a floodwall unit according to an embodiment of the present invention.

FIG. 7 shows the support frame 306 according to an embodiment of the present invention. The support frame 306 is configured to support the floodwall panel 120 and the counter-balance weight 308 in a first compartment 712 and a second compartment 710, respectively. In one embodiment, each of the two compartments has a height substantially the same as the housing unit 304. The two compartments may be arranged side by side. The support frame 306 further includes an actuator 704 that provides necessary force to raise the floodwall panel 120. The actuator may be any suitable mechanism that provides the needed force. For example, the actuator may be an electric motor. In one example, the torque or force produced by the actuator 704 is transmitted to the floodwall panel 120 and the counter-balance weight 308 by a plurality of pulleys 706 and a plurality of cables 708, which are attached to the floodwall panel 120 and the counter-balance weight 308. In one embodiment, the support frame 306 is made of a plurality of steel members 702 that forms a cage-like structure.

FIG. 7*a* shows the configuration of a floodwall unit when the floodwall panel is fully deployed according to an embodiment of the present invention. In the fully deployed position, the floodwall panel is raised to its highest point, while the counter-balance weight is at its lowest point. When the floodwall panel is retracted from the fully deployed position to the stowed position, the floodwall panel 120 is lowered into the housing unit, while the counter-balance weight rises to the upper part of the compartment 710. As also shown in FIG. 7*a*, the housing unit 304 may have slots or projections 714 at its two ends, which are used to mate with the slots and projections of an adjacent housing unit to form a fitted watertight connection.

Figure 8A:
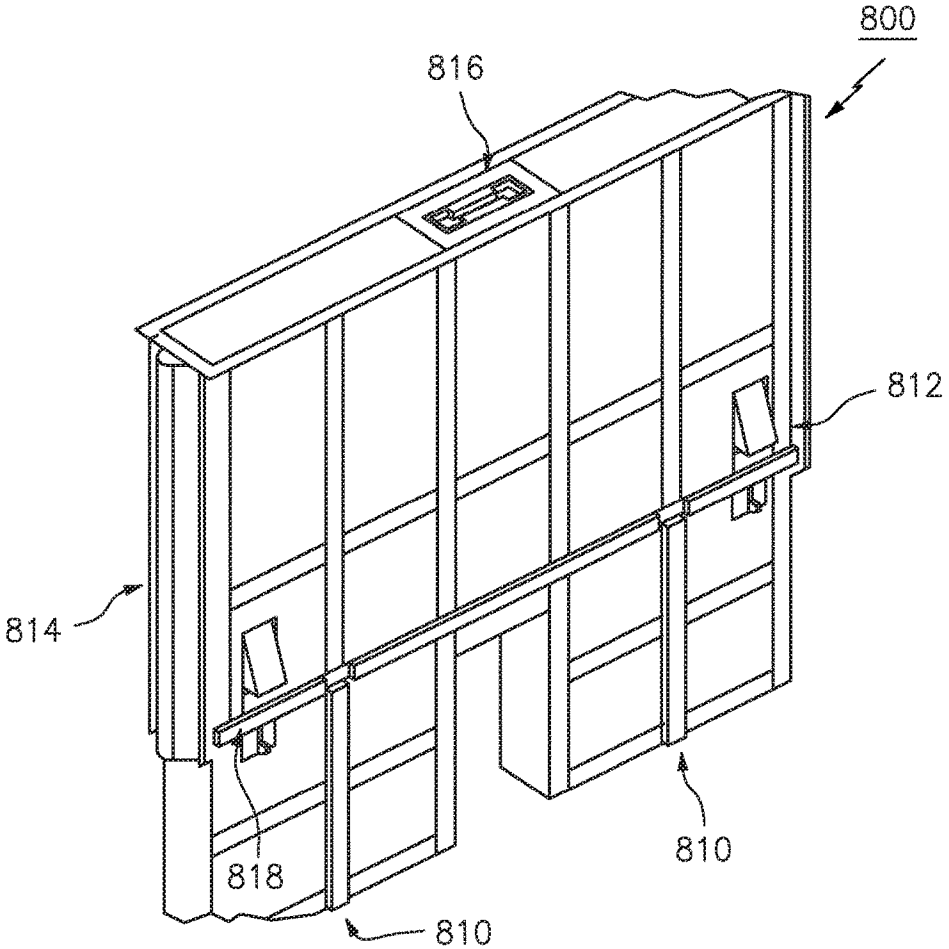
FIG. 8*a* illustrates a floodwall panel according to an embodiment of the present invention.
Figure 8:
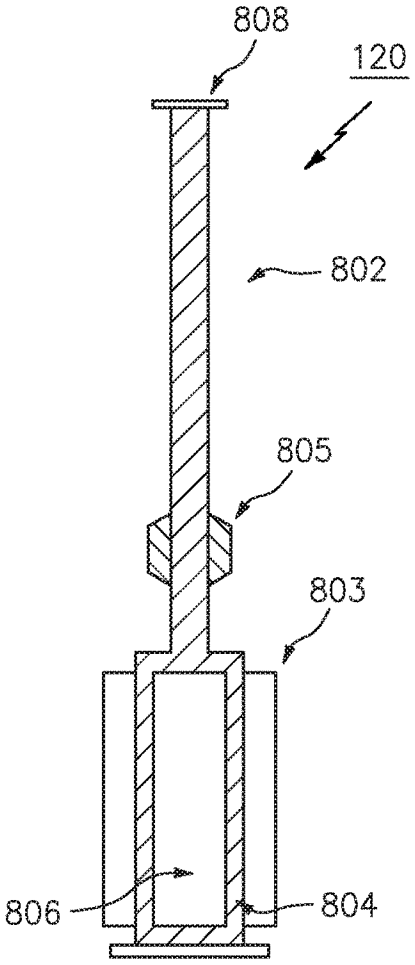
FIG. 8 illustrates a cross section of the floodwall panel with a void in the lower portion for buoyancy according to an embodiment of the present invention.

FIG. 8 shows a floodwall panel according to an embodiment of the present invention. The floodwall panel 120 has an upper section 802, a lower section 804, a plurality of guides 803, a plurality of horizontal seals 805, and a top drive over seal 808. As shown in FIG. 8, the upper section 802 is preferably solid and has adequate mechanical integrity to resist the hydrodynamic, hydrostatic and debris impact forces of floodwater. The lower section 804 may be configured to have a greater dimension than the upper section 802 and may occupy as much space as possible inside the housing unit 304, thereby making it buoyant. The inside section 806 of the lower section 804 is preferably hollow to reduce the weight and increase buoyancy. The floodwall panel 120 may be constructed from various materials, including steel, concrete, polymers, composite materials, and a combination thereof. As the lower section 804 may not be subject to forces from the flood water that is imposed on the upper section 802, the lower section 804 and the upper section 802 may be constructed by different materials. For example, the upper section may be constructed by pre-cast concrete while the bottom section may be constructed by plastic. The top drive over seal 808 is configured to seal the housing unit 304 when the floodwall panel is in the stowed position. The plurality of horizontal seals 805 may be used to create a watertight contact between the floodwall panel and the top surface 116 or insides surfaces of the housing unit when the floodwall panel is in the raised position. The plurality of guides 803, similar with the guides 612 of the housing unit 304, contact the inside surface of the housing unit and direct the floodwall panel to raise in an upright direction.

FIG. 8*a* shows an embodiment of a floodwall panel 800. The floodwall panel 800 has a vertical seal 814, a lifting latch mechanism 816, a plurality of leg supports 812, a plurality of horizontal seals 818, and a plurality of guides 810. The vertical seal 814 is configured to seal the gaps between two adjacent floodwall panels 800. The vertical seal 814 may be made of any suitable material in any configuration as long as the vertical seal 814 is capable of stopping water from running through the gaps. According to a preferred embodiment, vertical and horizontal seals are formed from an elastomer such as Neoprene, a polychloroprene based polymer. In one embodiment, the vertical seal 814 has a tubular shape with a hollowed inner portion. In another embodiment, the vertical seal 814 has a finger-like configuration. The latch mechanism 816 provides an attachment point with an external device that can be used to raise the floodwall panel 800. For example, when the floodwall panel 800 is raised manually, a worker may fit a handle into the latch mechanism 816 and use the handle to lift the floodwall panel 800. The plurality of leg supports 812 are used to support the floodwall panel 800 in a raised position. The leg supports 812 are spring-loaded and are pressed inside the floodwall panel 800 when the panel is not raised. According to an aspect of the invention, the leg supports engages with a plurality of horizontal edges and the inside surface of the housing unit and form a ratchet mechanism. The leg supports 812 are released when the floodwall panel is raised to a predetermined height and press against the top surface 116 to support the raised floodwall panel. With the leg supports 812 engaged with the top surface, the floodwall panel will be maintained in the raised position without the requirement of the torque or force from the actuators. When the floodwall panel 800 is retracted from a raised position to a stowed position, the leg supports 812 may be pushed back into the floodwall panel 800 by a plurality of cams or beveled protrusions installed on the side walls of the housing unit 304. The horizontal seal 818, similar with the horizontal seal 805 in FIG. 8, is used to provide a watertight contact between the lower section of the floodwall panel 800 and housing unit. The guides 810 are constructed at locations corresponding to the guides 612 on the side walls of the housing unit 304. The guides 810 and the guides 612 work together to ensure that the floodwall panel 800 is raised along an upright direction.

Figure 8B:
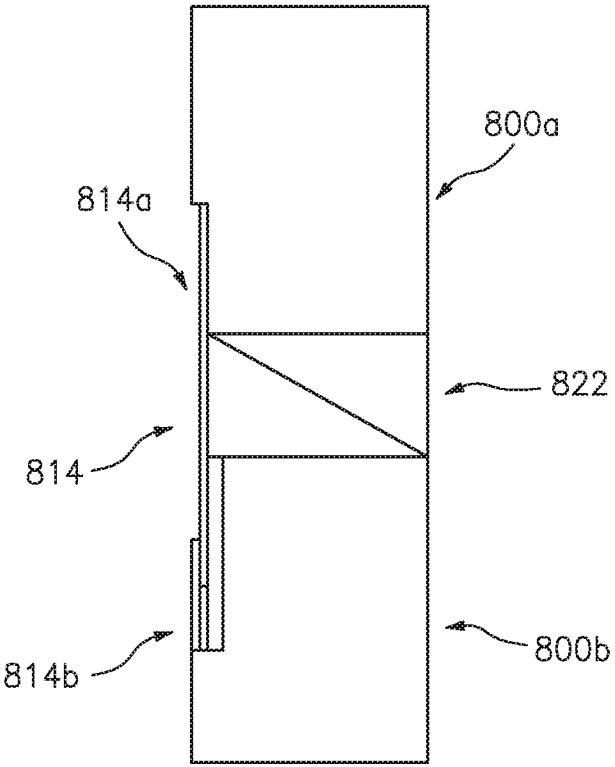
FIG. 8*b* illustrates a vertical seal between adjacent floodwall panels according to an embodiment of the present invention.

FIG. 8*b* is a top view showing another embodiment of vertical seals 814 between two floodwall panels 800*a* and 800*b*. The vertical seal 814 includes two parts: a first part 814*a* attached to the floodwall panel 800*a* and a second part 814*b* attached to the floodwall panel 800*b*. The first part 814*a* is substantially planar and extends across the gap 822. The second part 814*b* is U-shaped, which sandwiches the first part 814*a* between the two legs of the "U", thus forming a watertight seal.

Figure 9:
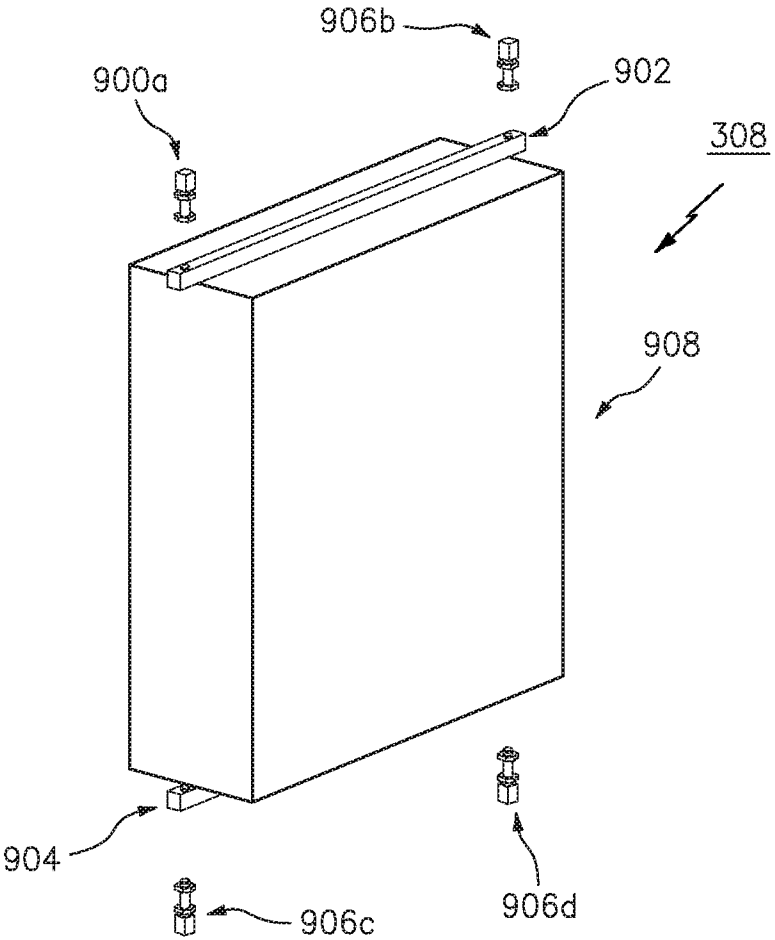
FIG. 9 illustrates a counter-balance weight according to an embodiment of the present invention.

FIG. 9 shows an embodiment of a counter-balance weight 308. The counter-balance weight 308 has a body portion 908 that is designed to provide a substantial amount of mass. To reduce the amount of force used to lift the floodwall panel, the mass of the body portion 908 needs to be comparable with the floodwall panel. In one example, the mass of the body portion 908 is between about 50% to 150% of the mass of the floodwall panel or preferable between about 80% to 120% of the mass of the floodwall panel or preferably about 90% of the mass of the floodwall panel. In one embodiment, the body portion 908 may be constructed by the same material as that of the floodwall panel, such as pre-cast reinforced concrete. In one embodiment, the body portion 908 is made of a material that has a greater density than the floodwall panel. For example, the body portion 908 may be made of lead, while the floodwall panel may be made of pre-cast concrete. The counter-balance weight 308 also includes an attachment mechanism, such as a plurality of bars 902 and 904 and a plurality of connectors 906*a*, 906*b*, 906*c*, and 906*d*, that are used to attach the weight 308 to the transmitting mechanism of the actuator as shown in FIG. 7*a*. It is noted that the floodwall panel may have similar bars and connectors for attachment with the transmitting mechanism of the actuator.

Figure 10:
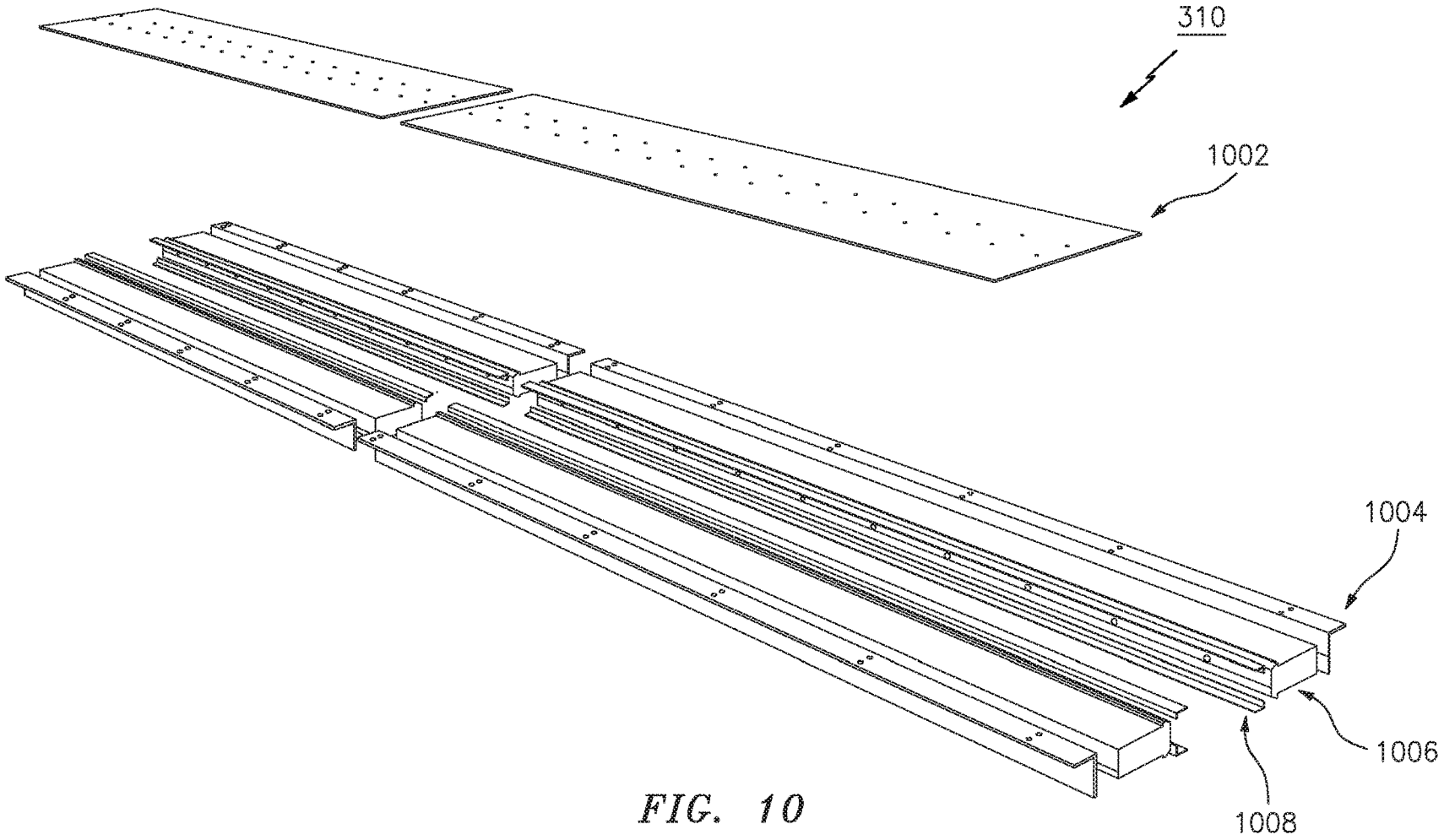
FIG. 10 illustrates a cover unit with watertight seals of a floodwall unit according to an embodiment of the present invention.

FIG. 10 shows a surface unit 310 according to an embodiment of the present invention. The surface unit 310 includes a cover plate 1002, an attachment part 1004, an extension part 1006, and a seal part 1008. The cover plate 1002 is configured to extend between the two attachment parts 1004, thus covering the housing unit 304 when the floodwall panel is retracted into the housing unit. The attachment part 1004 is used to attach the extension part 1006 to the housing unit 304. The extension part 1006 covers the gap between the upper section of the floodwall panel and the side walls of the housing unit 304 because the upper section of the floodwall panel may not occupy the entire span between two side walls of the housing unit 304. The seal part 1008 helps to form a watertight contact between the extension part 1006 and the floodwall panel 800. The extension part 1006 and the attachment part 1004 may be made of same materials or different materials. In one embodiment, the attachment part 1004 is made of a steel angle, and the extension part 1006 is made of plastic or rubber, such as acetal. Acetal, whose chemical name is polyoxymethylene, is an engineering thermoplastic that has high stiffness, low friction and excellent dimensional stability.

Figure 10A:
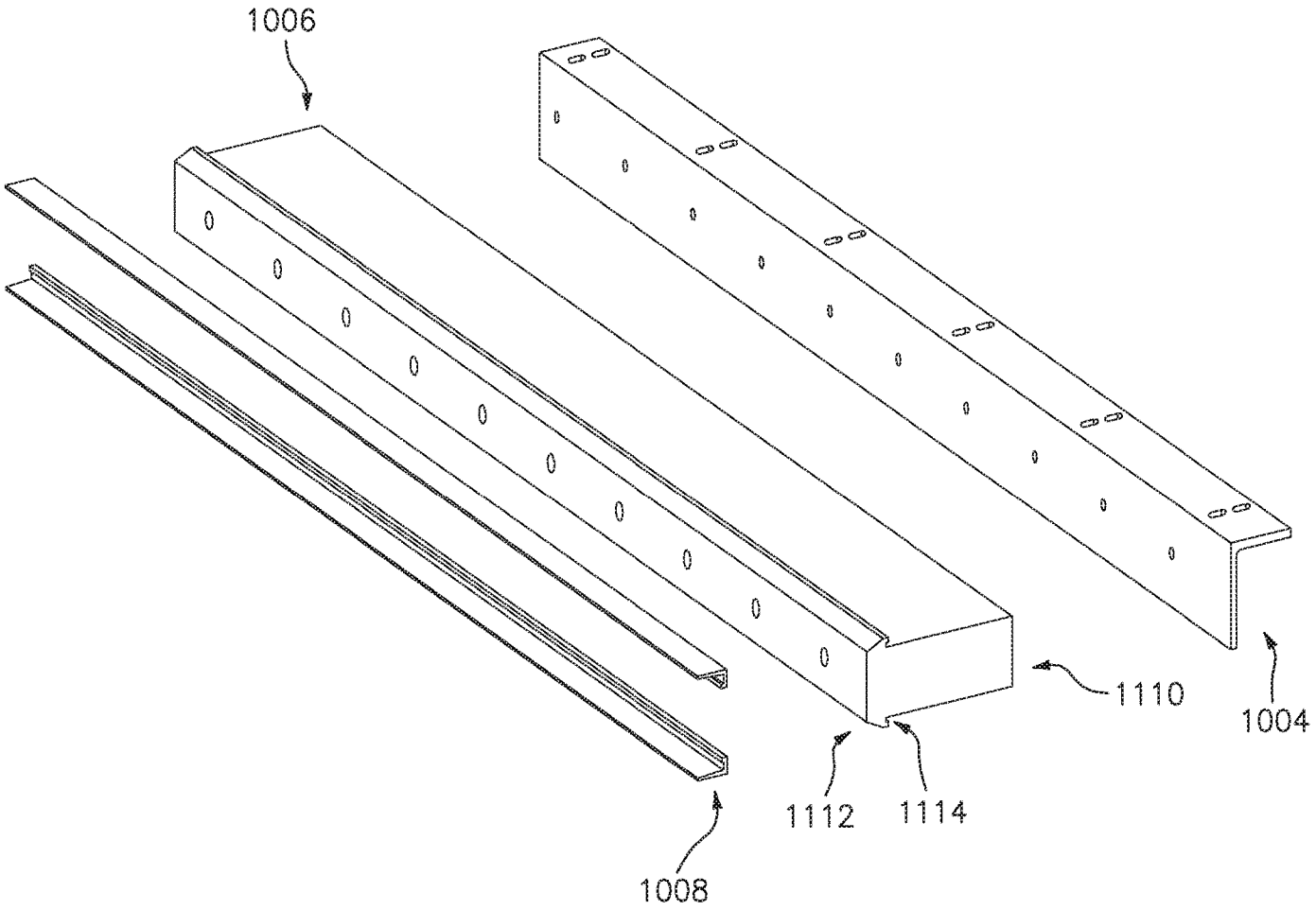
FIG. 10*a* illustrates seals of the cover unit of FIG. 10 according to an embodiment of the present invention.
Figure 10B:
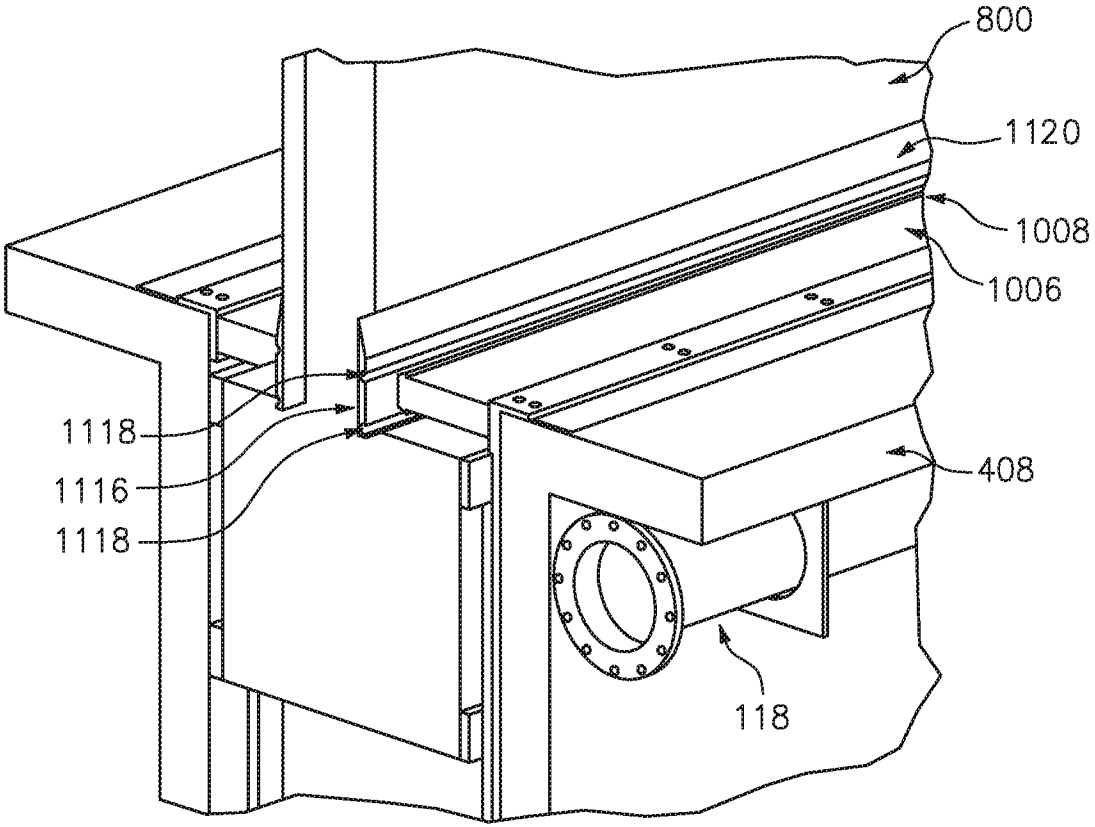
FIG. 10*b* illustrates the horizontal seals between the cover unit of FIG. 10 and the floodwall panel according to an embodiment of the present invention.

FIGS. 10*a* and 10*b* show the seal between the surface unit and the floodwall panel according an embodiment of the present invention. As shown in FIG. 10*a*, the extension part 1006 has a first end 1110 that fits tightly with the attachment part 1004. The extension part 1006 has a second end 1112 that is configured to retain the seal 1008. In one embodiment, the seal 1008 has a finger-like configuration, while the second end 1112 is T-shaped with a plurality of grooves 1114 that retain the seal 1008. As shown in FIG. 10*b*, when the floodwall panel 800 is in a raised position, the horizontal seal 1116 of the floodwall panel is in contact with the seal 1008 of the surface unit 310. The horizontal seal 1116 has a beveled part 1120 that is used to guide the seals 1008 into a plurality of grooves 1118. The extension part 1006 is also pushed tightly against the horizontal seal 1116 to prevent water from entering the housing unit.

Figure 11:
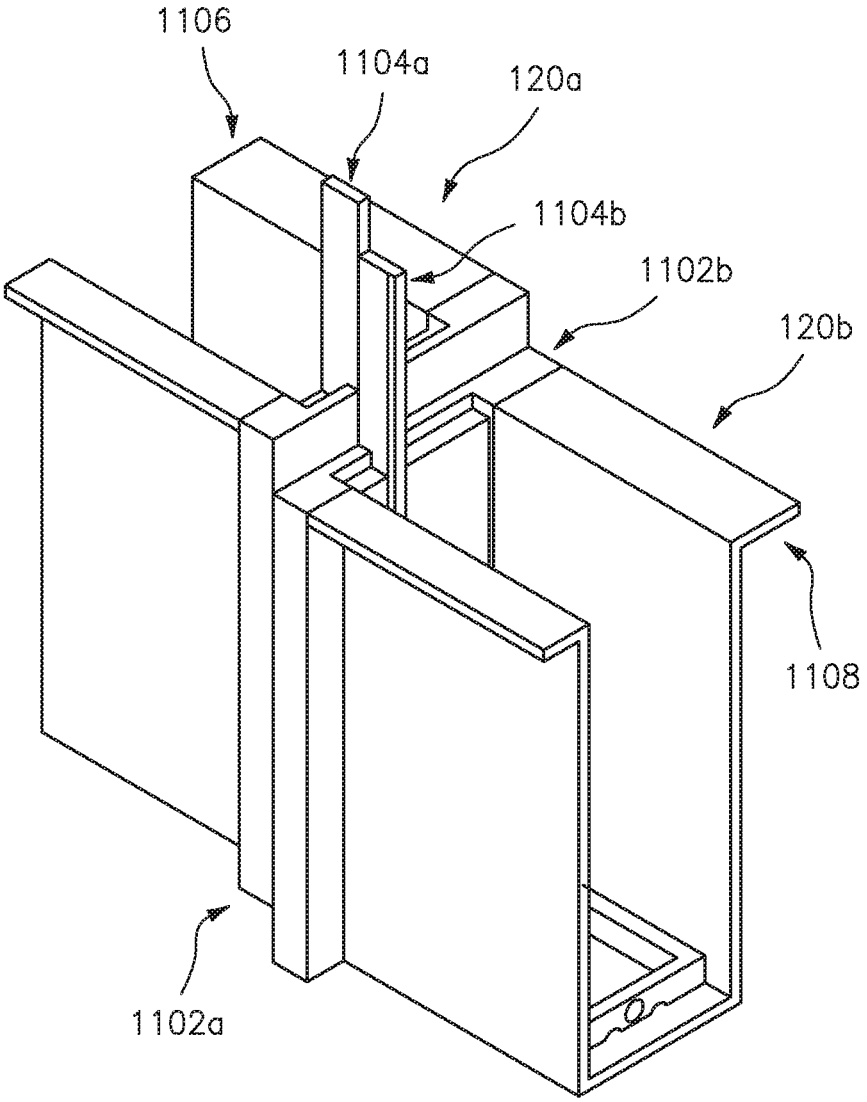
FIG. 11 illustrates connections between two floodwall units having different elevations according to an embodiment of the present invention.

FIG. 11 shows an attachment between adjacent housing units according to an embodiment of the present invention. The adjacent housing units 120*a* and 120*b* are placed at similar levels in most situations. But, they may be placed at different elevations due to the conditions of the foundation, which causes the projections 1106 and 1108 on the respective housing unit to be offset from each other. This offset between two housing units 120*a* and 120*b* creates gaps between adjacent floodwall panels in raised positions. To address this issue, the housing units 120*a* and 120*b* may further include end parts 1102*a* and 1102*b* and two end posts 1104*a* and 1104*b*. The two end parts 1102*a* and 1102*b* mate with each other and form a watertight contact. The two end posts 1104*a* and 1104*b* are installed on top of the end parts to cover any gaps caused by the offset. When the floodwall panel is raised, the floodwall panel forms a watertight contact with the end parts 1102 and the posts 1104.

Figure 12:
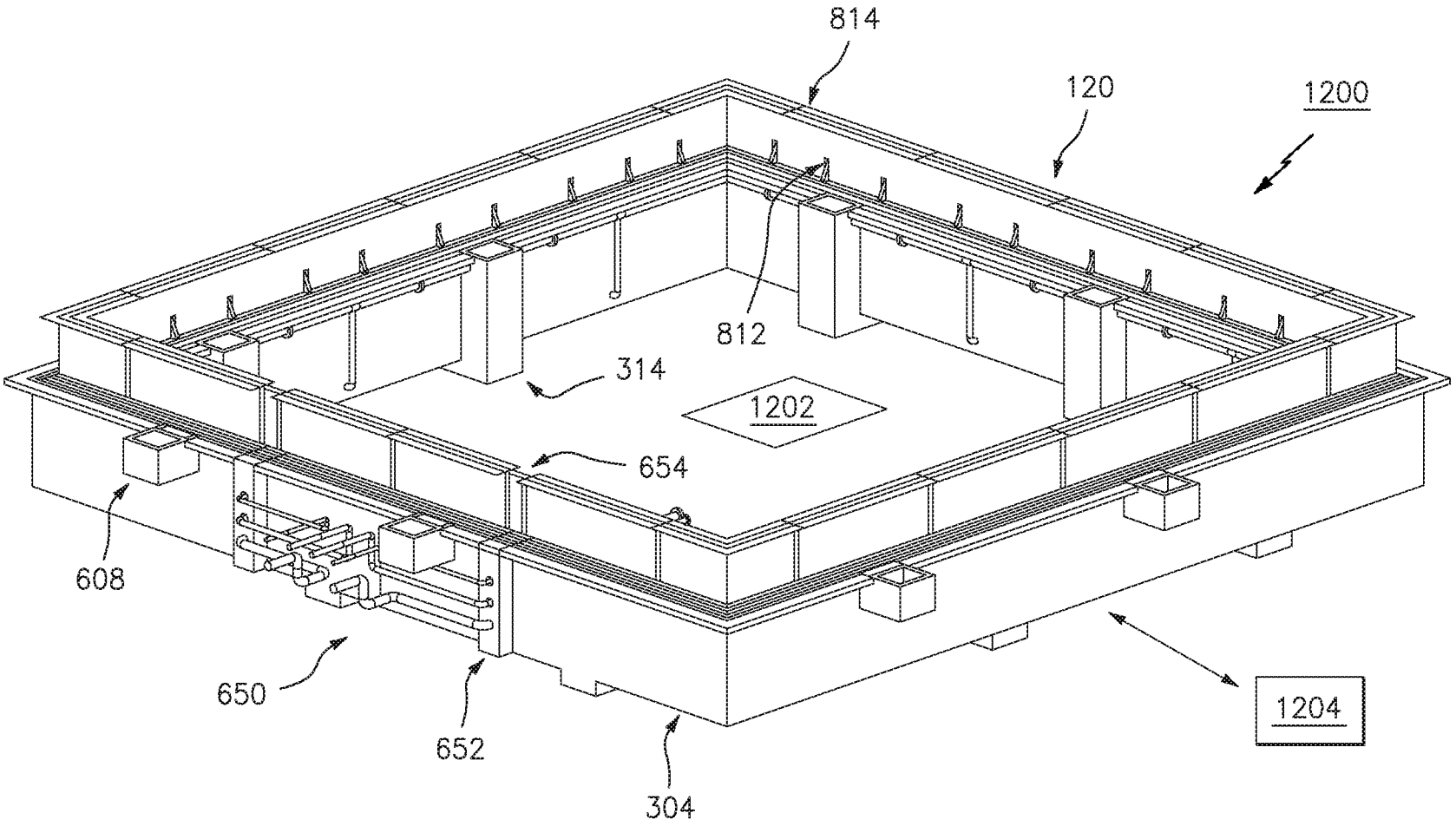
FIG. 12 illustrates a floodwall system forming an enclosure according to an embodiment of the present invention.

FIG. 12 shows a raised floodwall system 1200 forming an enclosure according to an embodiment of the present invention. The floodwall panels 120 are in a raised position with the support legs 812 released and engaged with the surface unit to support the floodwall panel 120. The floodwall panels have side seals 814 that cover gaps between adjacent floodwall panels. The exit segment 650 of the floodwall system is used as an ingress/egress point and provides utility openings in its fixed underground posts 652. The above-ground removable pillars 654 fit tightly with adjacent floodwall panels. The housing units 304 are buried underground. A plurality of pumps 314 are installed at predetermined locations. The passive inlets 608 are disposed at the flood-side of the floodwall system to allow flood water to enter the housing unit 304.

In one embodiment, the floodwall panels are raised manually by workers. In another embodiment, the floodwall panels are raised by a crane. In another embodiment, the floodwall panels are raised by the actuators inside the housing unit. In another embodiment, the floodwall panels are raised by water inside the housing unit, providing buoyant force. The water may be flood water, municipal water, or both. In another embodiment, the floodwall panels are raised by any combination of the above-discussed means.

The floodwall system 1200 as shown in FIG. 12 may be used to protect a building 1202 or even a city from flood damage. In one embodiment, the floodwall system 1200 may be controlled remotely by a controller 1204 that communicates with the floodwall system wirelessly. When the floodwall panels 120 need to be raised, an operator uses the controller 1204 to operate the floodwall system 1200. Upon receiving an instruction sent by the controller 1204, a local processor controls the actuators inside the housing units 318 to raise the floodwall panels sequentially or simultaneously. The height of the floodwall panel may be sensed and determined through a plurality of data, including the movement of the actuators, the number of rotations of the pulleys, or the travel distance of the cables/chains. In one embodiment, the controller may be a dedicated control center, a computer, a laptop, or a smartphone.

Figure 13:
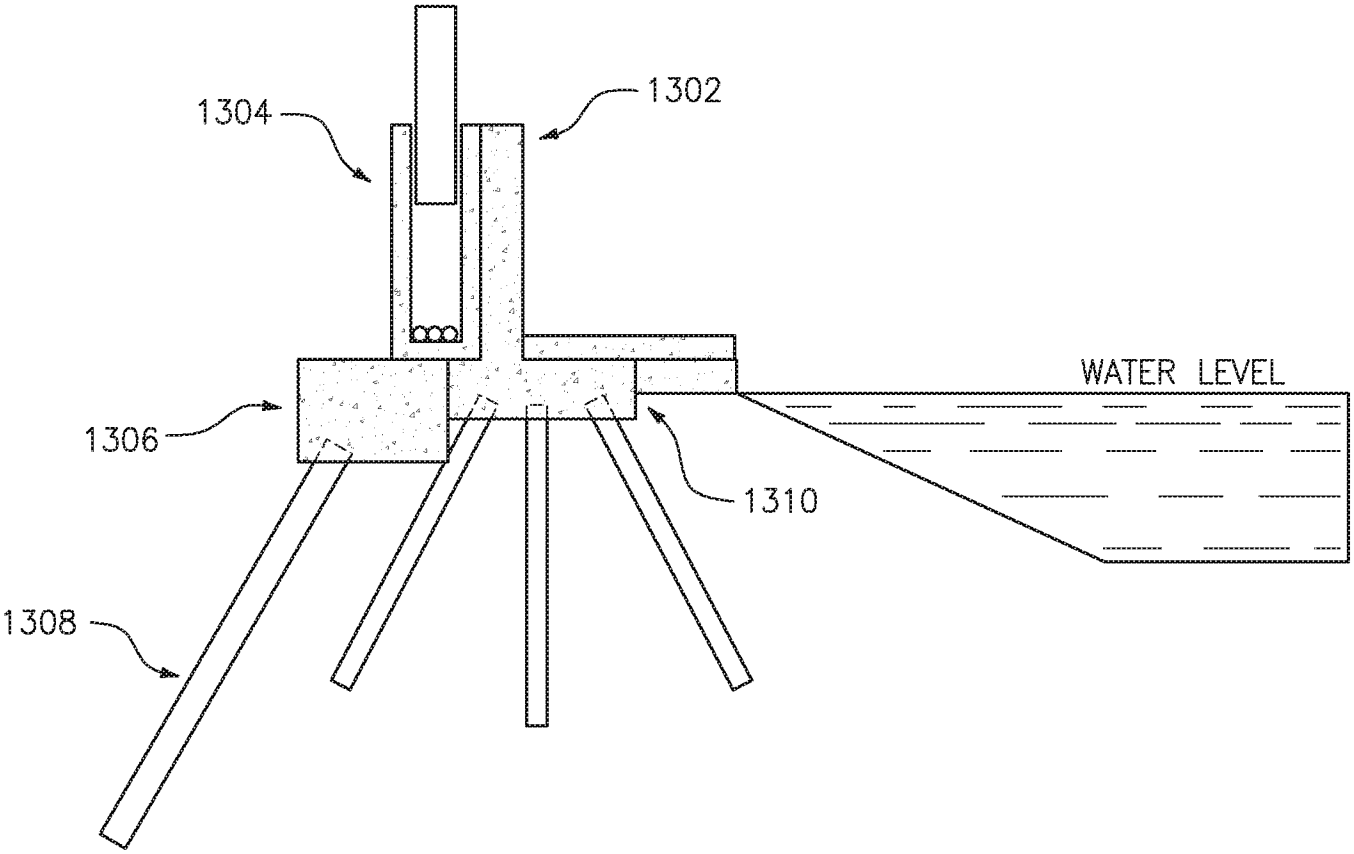
FIG. 13 illustrates a floodwall system connected with an existing floodwall according to an embodiment of the present invention.

FIG. 13 shows a retractable floodwall system installed on an existing floodwall structure according to an embodiment of the present invention. In this embodiment, the retractable floodwall system acts as both a levee extension and a levee support mounted behind the existing fixed floodwall. An existing floodwall structure 1302 is typically an above-ground and permanent structure with a fixed height. The structure 1302 can stop flood only when the water is below its height. The integrity of the structure 1302 may be reduced due to years of use and previous flood events, making it susceptible to failure, as when the flood protection system in New Orleans failed because of Hurricane Katrina. The floodwall system of the present invention may be used to strengthen and extend the height of an existing flood prevention structure.

As shown in FIG. 13, the retractable floodwall system 1304 may be attached to the existing structure 1302. To properly support the floodwall system 1304, additional foundation 1306 may be added to the existing foundation 1310. When needed, the foundation 1306 may also be supported by the batter piles 1308 that are driven into the ground. It is noted that the floodwall system 1304 in FIG. 13 is above the ground.

Figure 14:
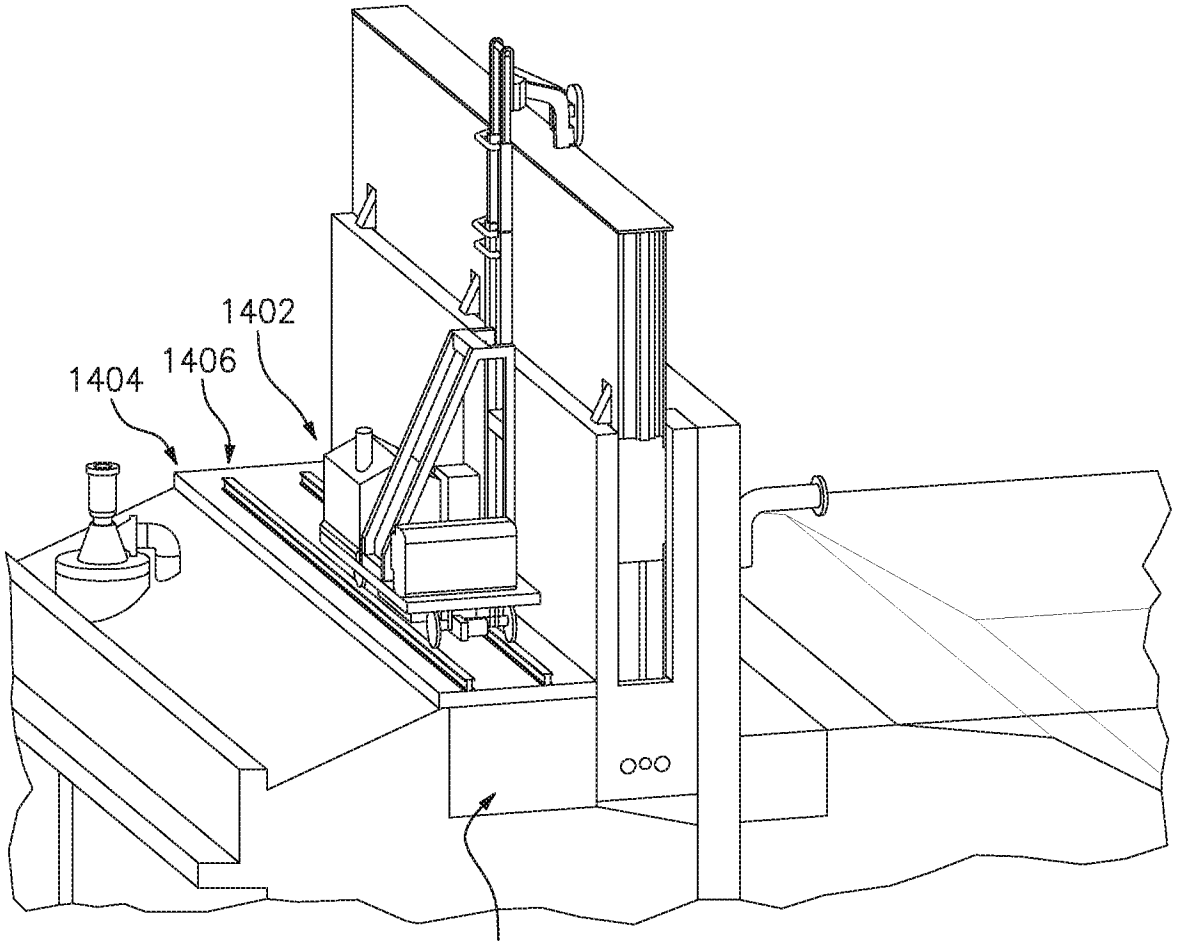
FIG. 14 illustrates a trolley for raising a floodwall panel according to an embodiment of the present invention.

FIG. 14 shows a deployment device for the floodwall system according to an embodiment of the present invention. As discussed above, the floodwall system may be used along bodies of water with a long shoreline, for example, along the banks of a river flowing through a city. In these situations, the floodwall system needs to cover a distance that is a few miles long or even hundreds of miles long. When each floodwall unit is equipped with an electromechanical mechanism, the construction and maintenance cost could be very high. In one embodiment shown in FIG. 14, the need for individual actuation mechanism is reduced. In this embodiment, the floodwall system may further include an automated deployment device to raise and lower the floodwall panels. As a result, actuators inside each individual housing unit become optional. The automated deployment device 1402 may be a trolley running along tracks 1406 and having an on-board lifting mechanism. The tracks 1406 are installed on a surface 1404, which sits on the foundation 1306. The foundation 1306, the surface 1404, and the tracks 1406 are constructed along the floodwall system. The automated deployment device 1402 can travel the length of the floodwall system along the tracks. The automated deployment device 1402, working like a train, may raise and lower the floodwall panels one by one without any intervention from a human worker. As the actuators inside the housing units are not required, this deployment device and method may lower the construction cost and reduce the maintenance expense associated with the floodwall system.

Figure 14B:
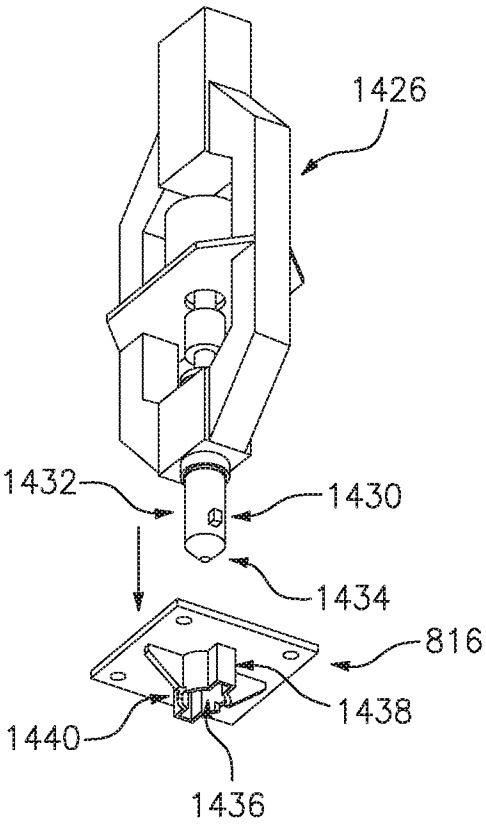
FIG. 14*b* illustrates a latch mechanism to raise and lower the floodwall between a trolley and a floodwall panel according to an embodiment of the present invention.
Figure 14A:
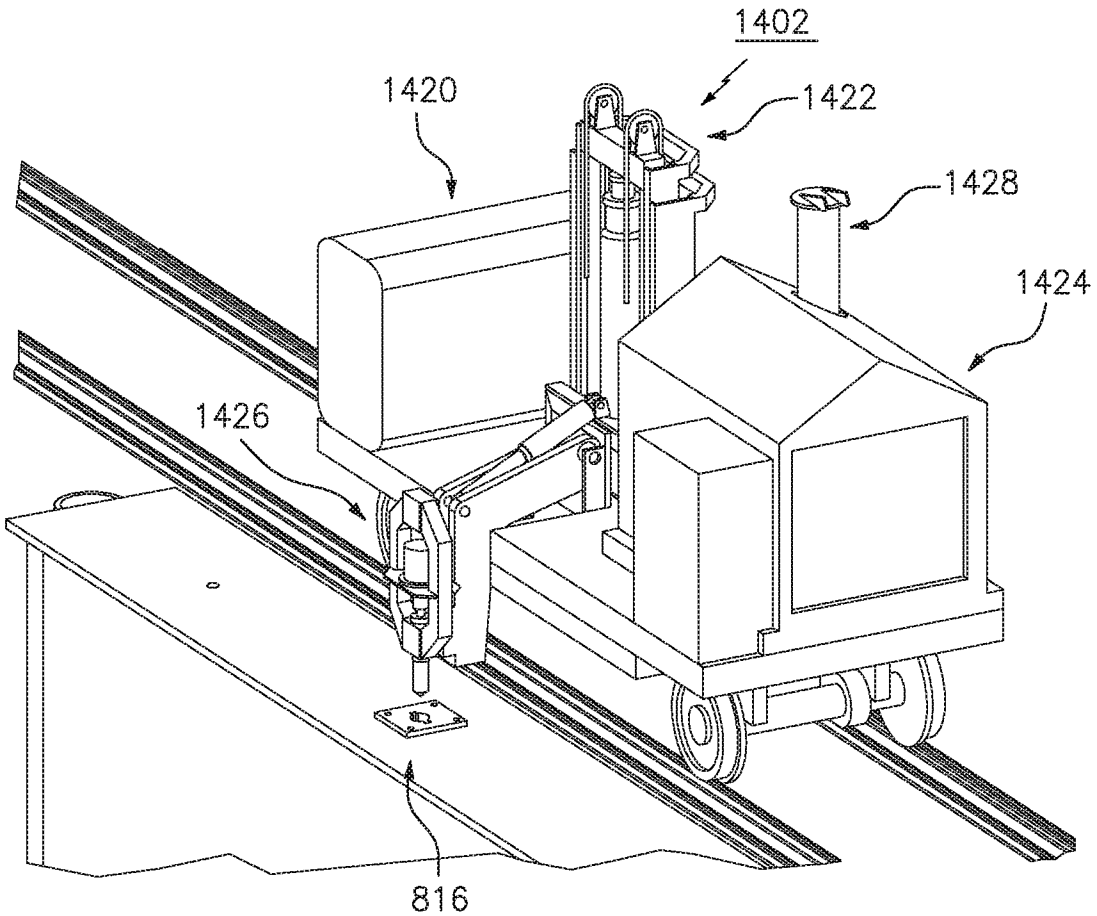
FIG. 14*a* illustrates the trolley of FIG. 14 according to an embodiment of the present invention.

FIG. 14*a* shows the automated deployment device according to an embodiment of the present invention. The automated deployment device includes a fuel storage 1420, a lifting mechanism 1422, an actuator 1428, and a controller 1424. The fuel storage 1420 may be a fuel tank, a battery, or any other suitable source. The fuel storage 1420 provides fuel to the actuator 1428, which may be an engine or an electric motor. Alternatively, electrical power can be supplied to the deployment device via an electrified rail. The lift mechanism 1422, which is connected with the actuator 1428, lifts and lowers the floodwall panels. The controller 1424 may include a processor that controls the operation of the lifting mechanism 1422 and the actuator 1428. The controller may also include a plurality of sensors that obtain various operation data, including the amount of fuel in the fuel storage 1420, the status of the actuator 1428, the movement of the lifting mechanism, and the height of the floodwall panel. In one embodiment, a GPS (Global Position System) sensor may be used to determine the locations of the trolley and the panel. The controller 1424 may also include a communication interface that transmits information to a remote control center 1204 and receives instructions from the remote control center 1204. The lifting mechanism 1422 includes an arm 1426 that mates with the latch mechanism 816 of a floodwall panel. After the arm 1426 is securely attached with the latch mechanism 816, the floodwall panel can be safely lifted or lowered.

FIG. 14*b* shows the arm 1426 and the latch mechanism 816 according to an embodiment of the present invention. The arm 1426 includes a tubular member 1432 that has a projection 1430 and a beveled end 1434. The tubular member 1432 and the projection 1430 mate with a socket 1436 of the latch mechanism 816 of a floodwall panel. After the tubular member 1432 and the projection 1430 are received by the socket 1436, the arm 1426 rotates the tubular member 1432 and the projection 1430 from a receiving position 1438 to a locking position 1440, thus forming a secure attachment between the arm 1426 and the latch mechanism 816.

According to an embodiment of the present invention, the floodwall system includes floodwall panels that are stored beneath ground to provide unobstructed access and views of a protected area. The system may be deployed to create a watertight enclosure. The system may be designed to be formed by sections, which are individually raised. According to one embodiment, the panels are from 7 feet to 30 feet in length. According to a preferred embodiment, the panels are between 10 feet and 15 feet long. According to a most preferred embodiment, the panels are about 10 feet long. The height of each section may range from 1 foot to 30 feet. By providing a counter weight, each section may be lifted quickly by a relatively small electric motor. According to one embodiment, a panel can be lifted by a two horsepower motor in 30 seconds. As an alternative to or in addition to an electric motor, buoyant force provided by water; either municipal water or flood water may also be used to lift the wall panel by filling the housing unit with water. As the floodwall panel is configured to have hollow chambers, the buoyant force is able to lift the panel with or without the assistance of an electric motor.

According to an embodiment of the invention, a controller is used to control the floodwall system via wired or wireless communication system. The controller may be a control panel, a computer, a laptop, or a smartphone. The floodwall panels may be raised all together to rapidly deploy the system or may be raised one-by-one to reduce the demand of electric power required for lifting the panels. The controller may be configured to control the height of the floodwall system and control the operation of the valves, sump pumps, and fill pumps. When the floodwall system is operated in a manual mode, the controller may be configured to monitor the wall positions and valve positions.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A retractable floodwall system comprising:

an underground housing unit enclosing a floodwall panel and an actuation mechanism that is connected with the floodwall panel;

an access panel that engages the underground housing unit at a top surface of the underground housing unit, the access panel being capable of supporting vehicles passing over the underground housing unit; and a plumbing system connected with the housing unit and adapted to deliver or remove a fluid from the housing unit, the plumbing system comprising a sparge pipe arranged within the underground housing unit;

wherein, in a stowed position, the underground housing unit, the floodwall panel, and the actuation mechanism are not above a grade level, and wherein the floodwall panel is configured to be raised by the actuation mechanism along a plurality of vertical guides.

2. The retractable floodwall system of claim 1, wherein the top surface of the underground housing unit has a horizontal projection that flushes with the grade level.

3. The retractable floodwall system of claim 2, wherein the horizontal projection is supported by a plurality of ribs.

4. The retractable floodwall system of claim 1, further comprising:

a plurality of batter piles that support the housing unit.

5. The retractable floodwall system of claim 1, wherein the top surface of the underground housing unit includes a first seal part that forms a watertight contact with a second seal part of the floodwall panel when the floodwall panel is raised above the grade level.

6. The retractable floodwall system of claim 1, wherein the plumbing system comprises an upper section and a lower section, wherein the upper section comprises at least one pipe; and wherein the lower section comprises the sparge pipe, and wherein the at least one pipe has an outer diameter that is larger than the sparge pipe.

7. The retractable floodwall system of claim 1, further comprising:

an exit segment; and an underground post located adjacent an end of the exit segment and having a plurality of openings in the post for utility lines to pass through.

8. The retractable floodwall system of claim 1, wherein the actuation mechanism is configured to be controlled via a wireless communication.

9. The retractable floodwall system of claim 1, wherein the floodwall panel includes a plurality of vertical seals that mate with an adjacent floodwall panel.

10. The retractable floodwall system of claim 9, wherein the plurality of vertical seals has a finger-like configuration.

11. The retractable floodwall system of claim 1, wherein the floodwall panel further includes a plurality of support legs that are configured to support the floodwall panel at a raised position.

12. The retractable floodwall system of claim 1, further comprising:

a support frame disposed inside the underground housing unit and configured to support the actuation mechanism.

13. The retractable floodwall system of claim 12, wherein the support frame is made of steel members and has a cage-like shape.

14. The retractable floodwall system of claim 1, further comprising a transmitting mechanism formed by cables and pulleys for transmitting lift forces from the actuation mechanism to the floodwall panel.

* * * * *